US008763620B1

(12) United States Patent
Tung

(10) Patent No.: US 8,763,620 B1
(45) Date of Patent: Jul. 1, 2014

(54) ROTATABLE SUNSHADE

(71) Applicant: Benson Tung, Kaohsiung (TW)

(72) Inventor: Benson Tung, Kaohsiung (TW)

( * ) Notice: Subject to any disclaimer, the term of this patent is extended or adjusted under 35 U.S.C. 154(b) by 25 days.

(21) Appl. No.: 13/733,175

(22) Filed: Jan. 3, 2013

(51) Int. Cl.
*A45B 17/00* (2006.01)

(52) U.S. Cl.
USPC ..... 135/20.1; 135/20.3; 135/98

(58) Field of Classification Search
USPC ..... 135/20.1, 20.3, 15.1, 16, 98
See application file for complete search history.

(56) References Cited

U.S. PATENT DOCUMENTS

| | | | | |
|---|---|---|---|---|
| 3,311,119 | A * | 3/1967 | Pearlstine | 135/20.3 |
| 3,926,202 | A * | 12/1975 | Uthemann et al. | 135/20.3 |
| 6,575,182 | B2 * | 6/2003 | Tung | 135/20.1 |
| 6,575,183 | B2 * | 6/2003 | Tung | 135/20.3 |
| 7,412,985 | B2 * | 8/2008 | Ma | 135/20.3 |
| 7,438,077 | B1 * | 10/2008 | Wilson | 135/20.3 |
| 7,958,901 | B2 * | 6/2011 | Lai | 135/20.3 |
| 8,291,923 | B2 * | 10/2012 | Young et al. | 135/20.1 |
| 8,522,804 | B1 * | 9/2013 | Tung | 135/20.1 |
| 8,534,304 | B1 * | 9/2013 | Tung | 135/20.1 |
| 2011/0005558 | A1 * | 1/2011 | Lai | 135/20.1 |

* cited by examiner

*Primary Examiner* — Noah Chandler Hawk
(74) *Attorney, Agent, or Firm* — Alan Kamrath; Kamrath IP Lawfirm, P.A.

(57) ABSTRACT

A rotatable sunshade includes a pole rotatably coupled to a connection tube fixed to a base. A runner is slideably mounted around the pole to fold, unfold, or tilt a canopy. A control tube is slideably mounted around the pole. When the canopy is tilted and the control tube is in an engagement position, at least one tooth of the control tube engages with at least one tooth of a positioning ring fixed to the connection tube, and the pole is not rotatable about a longitudinal axis of the pole relative to the connection tube. When the canopy is tilted and the control tube is in a disengagement position, the at least one tooth of the control tube disengages from the at least one tooth of the positioning ring, and the pole is rotatable about the longitudinal axis relative to the connection tube.

10 Claims, 21 Drawing Sheets

ROTATABLE SUNSHADE

BACKGROUND OF THE INVENTION

The present invention relates to a sunshade and, more particularly, to a sunshade that can be rotated in response to a change in the position of the sun.

A type of outdoor sunshade includes a pole located on the ground and a plurality of ribs each having an end pivotably connected to a top end of the pole. A runner is slideably mounted to the pole. A plurality of stretchers is pivotably connected between the runner and the ribs. A canopy is provided on the ribs. The runner can be moved towards or away from the top end of the pole to unfold or fold the canopy. The pole is fixed to a heavy base to avoid undesired rotation of the sunshade while the canopy is under a strong wind load. To provide an enhanced shielding effect, the unfolded canopy can be tilted according to the position of the sun. However, the positions of the sun in the morning, at noon, and in the afternoon, are so different from each other that the tilted canopy may not be able to provide a satisfactory shielding effect, and it is difficult to move the heavy base in response to the significant positional change of the sun.

Thus, a need exists for a rotatable sunshade providing enhanced shielding effect through easy operation.

BRIEF SUMMARY OF THE INVENTION

The present invention solves this need and other problems in the field of easy rotational operation of sunshades by providing a rotatable sunshade including a pole having upper and lower ends spaced from each other along a longitudinal axis of the pole. The pole further includes an outer periphery and an inner periphery spaced from the outer periphery in a radial direction perpendicular to the longitudinal axis of the pole. The inner periphery of the pole defines a longitudinal hole. A connection tube includes first and second coupling sections spaced from each other along the longitudinal axis of the pole. The lower end of the pole is rotatably coupled to the first coupling section of the connection tube. The second coupling section of the connection tube is adapted to be fixed to a base.

A positioning ring is fixed around the connection tube and includes first and second faces. At least one tooth is formed on the second face of the positioning ring and extends beyond an outer periphery of the connection tube. A runner is mounted around the pole and slideable relative to the pole. A plurality of stretchers is provided, with each stretcher having a first end pivotably connected to the runner and a second end spaced from the first end along a longitudinal axis of the stretcher. The plurality of stretchers is jointly movable with the runner and the follower. A fixing member is fixed to the upper end of the pole. A pivotable member is pivotably connected to the fixing member. A hub is mounted to the pivotable member. The hub and the pivotable member are jointly pivotable between first and second positions. A plurality of ribs is provided, with each rib including a connecting end pivotably connected to the hub. The second end of each of the plurality of stretchers is pivotably connected to one of the plurality of ribs. A canopy is adapted to be mounted to the plurality of ribs.

A housing is mounted around the pole and includes a partitioning board dividing an interior of the housing into a movement space and a mounting space below the movement space along the longitudinal axis of the pole. A control tube is mounted around the pole and includes an operation end and an engagement end spaced from the operation end along the longitudinal axis of the pole. The control tube further includes an inner periphery and an outer periphery spaced from the inner periphery in a radial direction perpendicular to the longitudinal axis of the pole. The inner periphery of the control tube defines a receiving hole receiving the pole and the connection tube. At least one tooth is formed on the inner periphery of the control tube at the engagement end. The operation end of the control tube is located outside of the movement space of the housing. The engagement end of the control tube is located in the mounting space. The positioning ring is located above the at least one tooth of the control tube. The control tube is slideable along the longitudinal axis of the pole between an engagement position and a disengagement position.

A retaining ring is mounted around the control tube and between the operation end and the engagement end. The retaining ring is received in the movement space and abuts the partitioning board. A spring is mounted between the operation end of the control tube and the retaining ring. The spring biases the control tube from the disengagement position to the engagement position.

When the runner moves along the longitudinal axis of the pole towards the hub, the plurality of stretchers moves the plurality of ribs away from the pole for unfolding the canopy. When the runner moves along the longitudinal axis of the pole away from the hub, the plurality of stretchers moves the plurality of ribs towards the pole for folding the canopy.

When the canopy is unfolded and the pivotable member is in the first position, the canopy is not tilted relative to the pole. When the canopy is unfolded and the pivotable member is in the second position, the canopy is tilted relative to the pole.

When the canopy is tilted and the control tube is in the engagement position, the at least one tooth of the control tube engages with the at least one tooth of the positioning ring. The pole is not rotatable about the longitudinal axis relative to the connection tube.

When the canopy is tilted and the control tube is in the disengagement position, the at least one tooth of the control tube disengages from the at least one tooth of the positioning ring, the pole is rotatable about the longitudinal axis relative to the connection tube.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
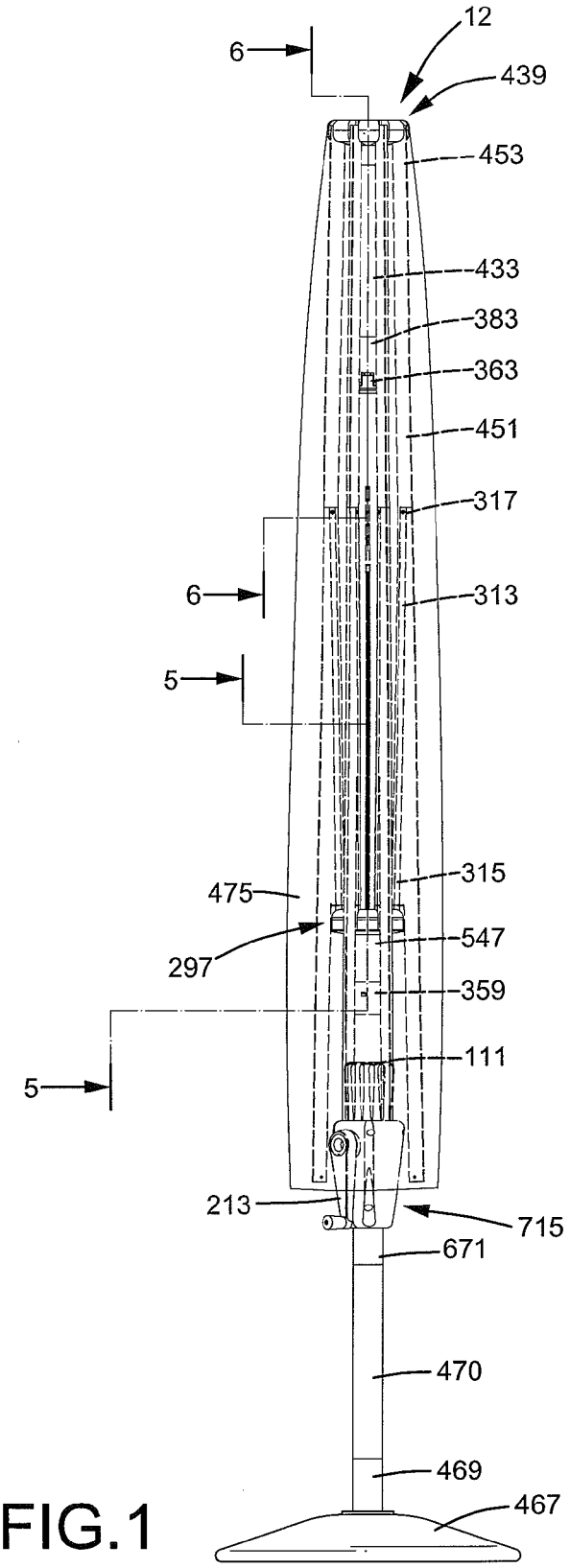
FIG. 1 shows a side elevational view of a rotatable sunshade according to the present invention, with the rotatable sunshade in a folded state.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "lower", "upper", "outer", "inner", "end", "portion", "section", "longitudinal", "radial", "annular", "spacing", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

A rotatable sunshade according to the present invention is shown in the drawings and generally designated 12. Rotatable sunshade 12 includes a pole 111 having upper and lower ends 113 and 115 spaced along a longitudinal axis of pole 111. Pole 111 further includes inner and outer peripheries 114 and 112 extending between upper and lower ends 113 and 115, with inner and outer peripheries 114 and 112 spaced from each other in a radial direction perpendicular to the longitudinal axis of pole 111, and with inner periphery 114 defining a longitudinal hole 117. A slot 119 extends from outer periphery 112 through inner periphery 114 in the radial direction and includes first and second ends 131 and 133, with first end 131 of slot 119 located between upper end 113 of pole 111 and second end 133 of slot 119 along the longitudinal axis of pole 111. First and second holes 137 and 139 extend from outer periphery 112 through inner periphery 114 and are aligned with each other, with each of first and second holes 137 and 139 located between second end 133 of slot 119 and lower end 115 of pole 111. Pole 111 further includes a plurality of through-holes 135 extending from outer periphery 112 through inner periphery 114, with through-holes 135 spaced from each other in a circumferential direction about the longitudinal axis of pole 111.

According to the form shown, a connection tube 657 includes a first coupling section 659, a second coupling section 671 below first coupling section 659, and a third coupling section 673 between the first and second coupling sections 659 and 671. Each of first, second, and third coupling section 659, 671, and 673 has an outer diameter perpendicular to the longitudinal axis of pole. The outer diameter of third coupling section 673 is smaller than the outer diameter of second coupling section 671, forming a first shoulder 675 between second and third coupling sections 671 and 673. The outer diameter of third coupling section 673 is larger than the outer diameter of first coupling section 659, forming a second shoulder 677 between first and third coupling sections 659 and 673. Lower end 115 of pole 111 is rotatably mounted around first coupling section 659 of connection tube 657.

According to the form shown, rotatable sunshade 12 further includes a base 467 having a tube 469. A middle tube 470 is fixed to tube 469. Second coupling section 671 of connection tube 657 is fixed in middle tube 470. Thus, pole 111 is rotatable relative to connection tube 657, middle tube 470, tube 469, and base 467.

According to the form shown, a positioning ring 679 is fixed around third coupling section 673 of connection tube 657. Positioning ring 679 includes first and second faces 691 and 693, with second face 693 located between second coupling section 671 and first face 691. A plurality of teeth 695 is formed on second face 693 and extends beyond an outer periphery of third coupling section 673. Each tooth 695 abuts first shoulder 675 of connection tube 657.

According to the form shown, a rotational tube 697 is rotatably mounted around first coupling section 659 of connection tube 657 and has an abutment flange 699 on a lower end thereof. Rotational tube 697 is received in longitudinal hole 117 at lower end 115 of pole 111 and located between first coupling section 659 and lower end 115 of pole 111. An outer periphery of rotational tube 697 is fixed, such as by bonding, to inner periphery 114 of pole 111. Abutment flange 699 abuts first face 691 of positioning ring 679. End face of lower end 115 of pole 111 abuts abutment flange 699 of rotational tube 697. Thus, pole 111 and rotational tube 697 are jointly rotatable relative to connection tube 657. A fixing ring 713 is mounted around a distal end of first coupling section 659 of connection tube 657, fixing connection tube 657 between fixing ring 713 and positioning ring 679 and preventing connection tube 657 from disengaging from first coupling section 659 of connection tube 657.

According to the form shown, a control tube 571 is mounted around pole 111 and slideable along the longitudinal axis of pole 111. Control tube 571 includes an operation end 573 and an engagement end 575 below operation end 573. Control tube 571 further includes an inner periphery 576 and an outer periphery 578 spaced from inner periphery 576 in the radial direction. Inner periphery 576 of control tube 571 defines a receiving hole 577 receiving pole 111 and connection tube 657. A plurality of inner teeth 597 is formed on inner periphery 576 at engagement end 575. A plurality of teeth 595 is formed on outer periphery 578 at operation end 573 and spaced from each other in a circumferential direction. Control tube 571 further includes a plurality of receiving slots 593, with each receiving slot 593 extending from an end face of operation end 573 along the longitudinal axis of pole 111 towards but spaced from engagement end 575 and extending from inner periphery 576 through outer periphery 578. Control tube 571 further includes a first opening 579 and a second opening 591 diametrically aligned with first opening 579. Each of first and second opening 579 and 591 extends from inner periphery 576 through outer periphery 578. Each of first and second opening 579 and 591 is located between each receiving slot 593 and inner teeth 597 at engagement end 575.

Operation end 573 of control tube 571 is around pole 111. Engagement end 575 of control tube 571 is around connection tube 657. Rotational tube 697 and positioning ring 679 are located between engagement end 575 of control tube 571 and first coupling section 659 of connection tube 657. Positioning ring 679 is located between inner teeth 597 of control tube 571 and first coupling section 659 of connection tube 657 and located between abutment flange 699 of rotational tube 697 and inner teeth 597 of control tube 571 along the longitudinal axis of pole 111.

Figure 14:
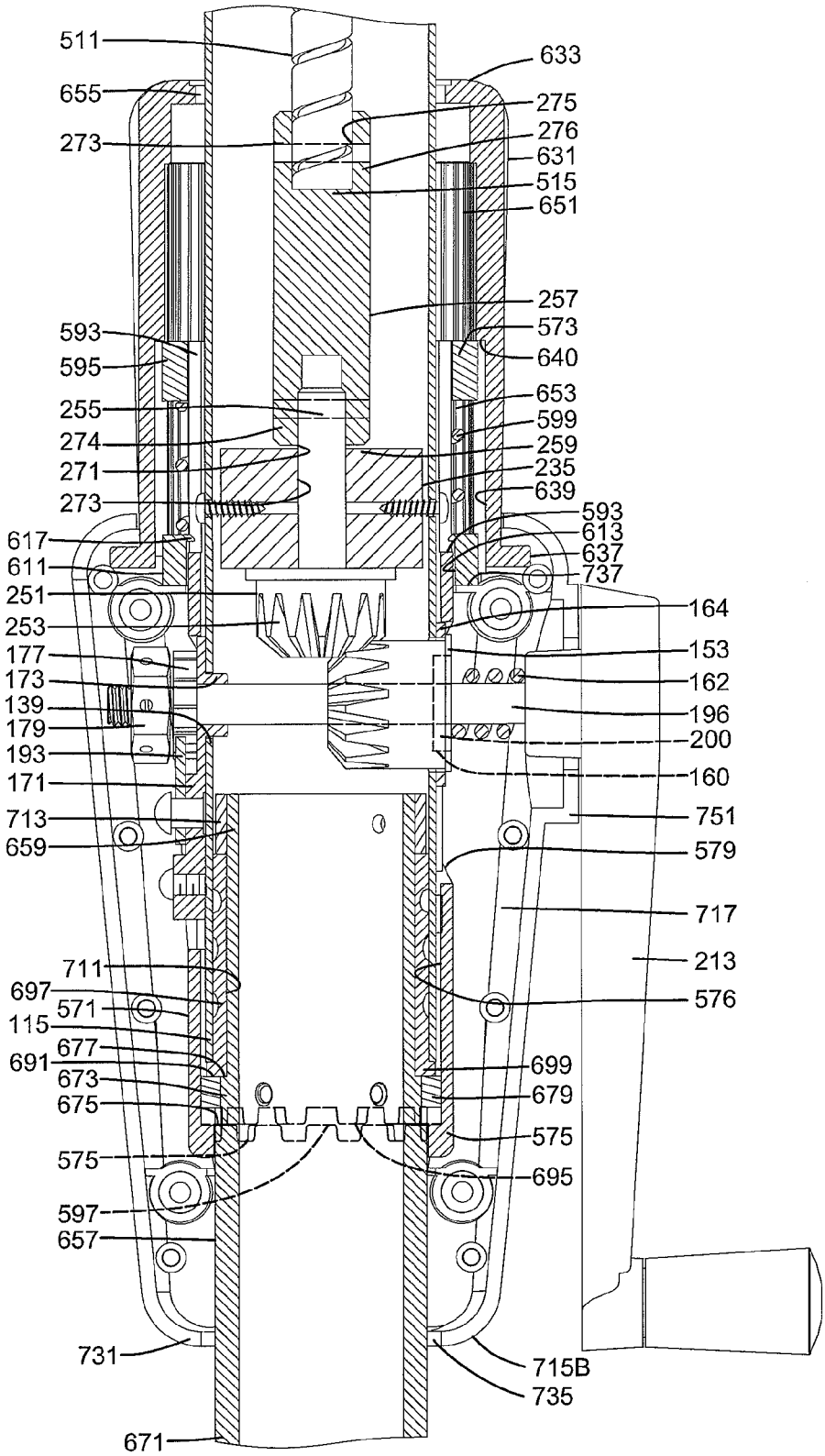
FIG. 14 shows a cross sectional view similar to FIG. 4, with a control tube moved to a disengagement position.

Control tube 571 is movable along the longitudinal axis of pole 111 between an engagement position (FIG. 4) and a disengagement position (FIG. 14). When control tube 571 is in the engagement position, inner teeth 597 of control tube 571 engage with teeth 695 of positioning ring 679. When control tube 571 is in the disengagement position, inner teeth 597 of control tube 571 disengage from teeth 695 of positioning ring 679.

According to the form shown, a retaining ring 611 is mounted around control tube 571 and includes inner and outer peripheries 613 and 615. A plurality of inner teeth 617 is provided on inner periphery 613, and a plurality of outer teeth 619 is provided on outer periphery 615. Each inner tooth 617 is received in one of receiving slots 593 and slideable along the longitudinal axis of pole 111, such that retaining ring 611 moves between teeth 595 and a bottom of each receiving slot 593. A spring 599 is mounted between retaining ring 611 and teeth 595 of control tube 571. Spring 599 biases each inner tooth 617 of retaining ring 611 to press against the bottom of one of receiving slots 593 of control tube 571.

According to the form shown, a rotating sleeve 631 is engaged with engagement end 575 of control tube 571 and jointly moveable with control tube 571. Rotating sleeve 631 includes upper and lower ends 633 and 635 spaced from each other along the longitudinal axis of pole 111. Rotating sleeve 631 further includes an inner periphery 639 defining a compartment 651. A plurality of teeth 653 is formed on inner periphery 639 and engages with outer teeth 619 of retaining ring 611, allowing joint movement of retaining ring 611 and rotating sleeve 631. Compartment 651 has an opening 655 in upper end 633 of rotating sleeve 631. A flange 637 is formed on an outer periphery of rotating sleeve 631 and located at lower end 635. Inner periphery 639 of rotating sleeve 631 includes an abutment wall 640 between opening 655 and teeth 653. Pole 111 is received in rotating sleeve 631. Slot 119 of pole 111 is located above rotating sleeve 631 along the longitudinal axis of pole 111. Teeth 595 of control tube 571 are located in compartment 651 of rotating sleeve 631 and engage with teeth 653 of rotating sleeve 631. An end face of operation end 573 of control tube 571 abuts abutment wall 640 of rotating sleeve 631. Thus, rotating sleeve 631 and control tube 571 are jointly rotatable about the longitudinal axis of pole 111.

According to the form shown, a first transmission member 151 is rotatably mounted in first hole 137. First transmission member 151 includes a toothed portion 155 with a flange 153 on a side thereof. An axial hole 159 extends from the side of toothed portion 155 through the other side of toothed portion 155. A pin groove 160 is formed in the side of toothed portion 155 and in communication with axial hole 159. Toothed portion 155 is received in longitudinal hole 117 of pole 111. A washer 164 is mounted between flange 153 and outer periphery 112 of pole 111. A seat 171 is fixed by screws to outer periphery 112 of pole 111 and includes a pivot hole 173 aligned with second hole 139 of pole 111 and axial hole 159 of first transmission member 151. Seat 171 is received in second opening 591 of control tube 571.

Figure 4:
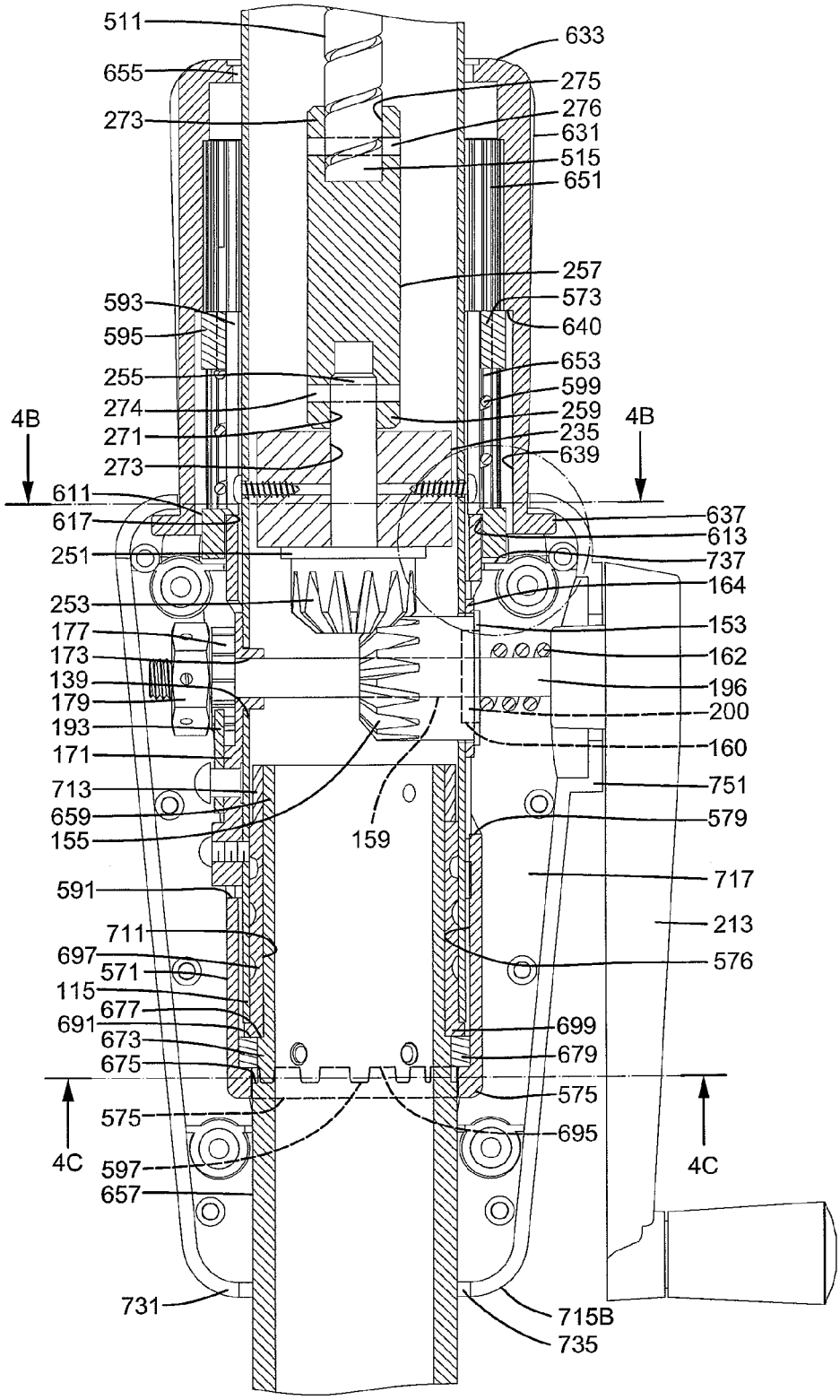
FIG. 4 shows a cross sectional view of the rotatable sunshade according to section line 4-4 of FIG. 2.
Figure 4A:
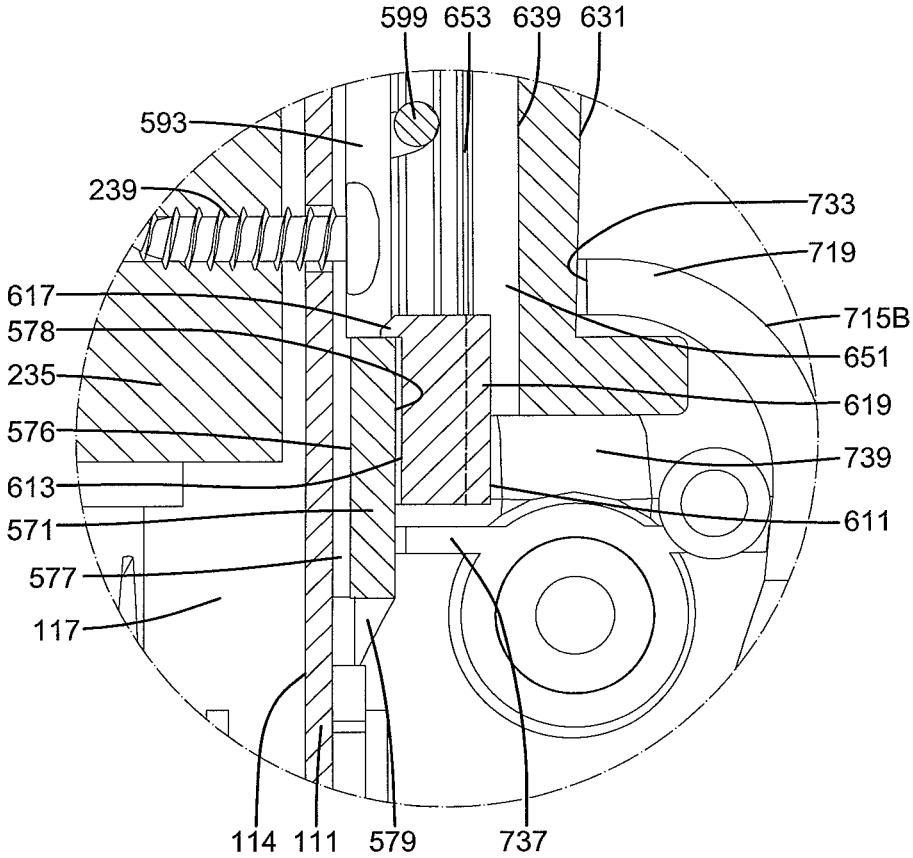
FIG. 4A shows an enlarged view of a circled portion of FIG. 4.
Figure 4B:
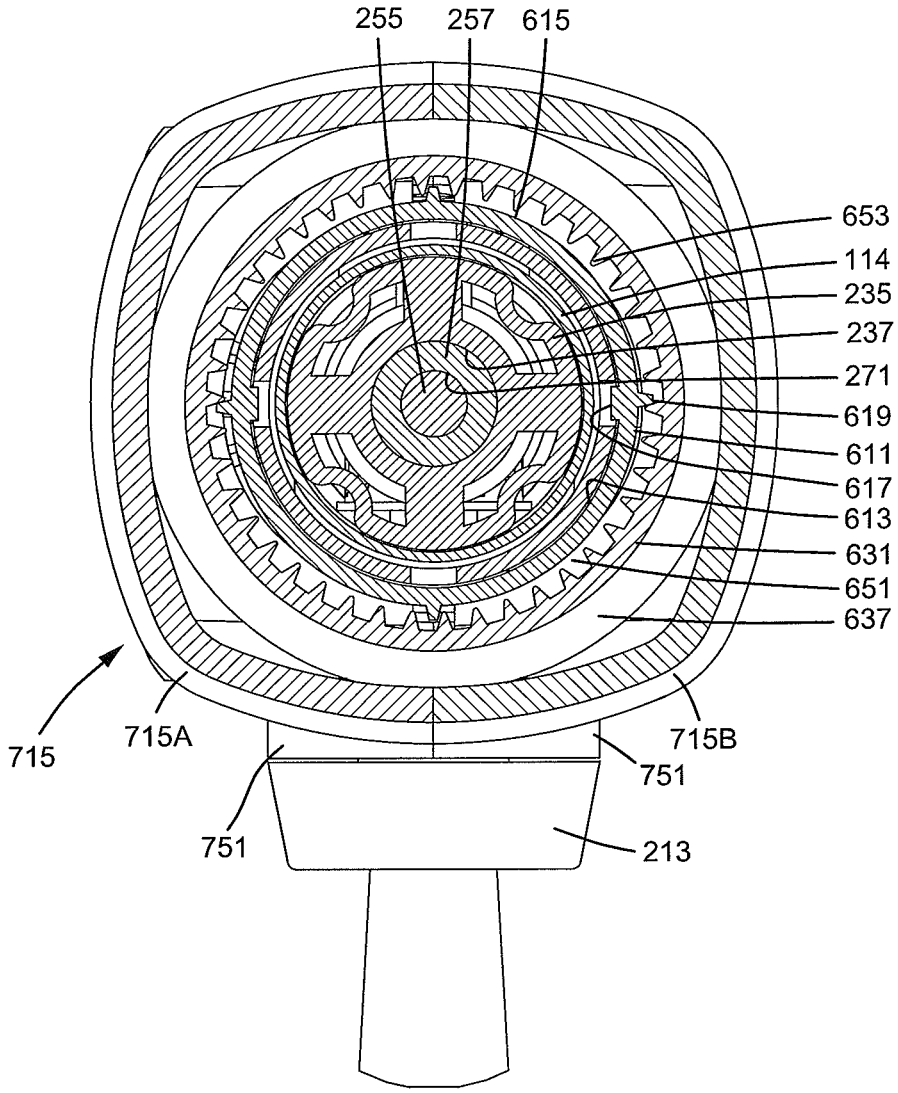
FIG. 4B shows a cross sectional view taken along section line 4B-4B of FIG. 4.
Figure 4C:
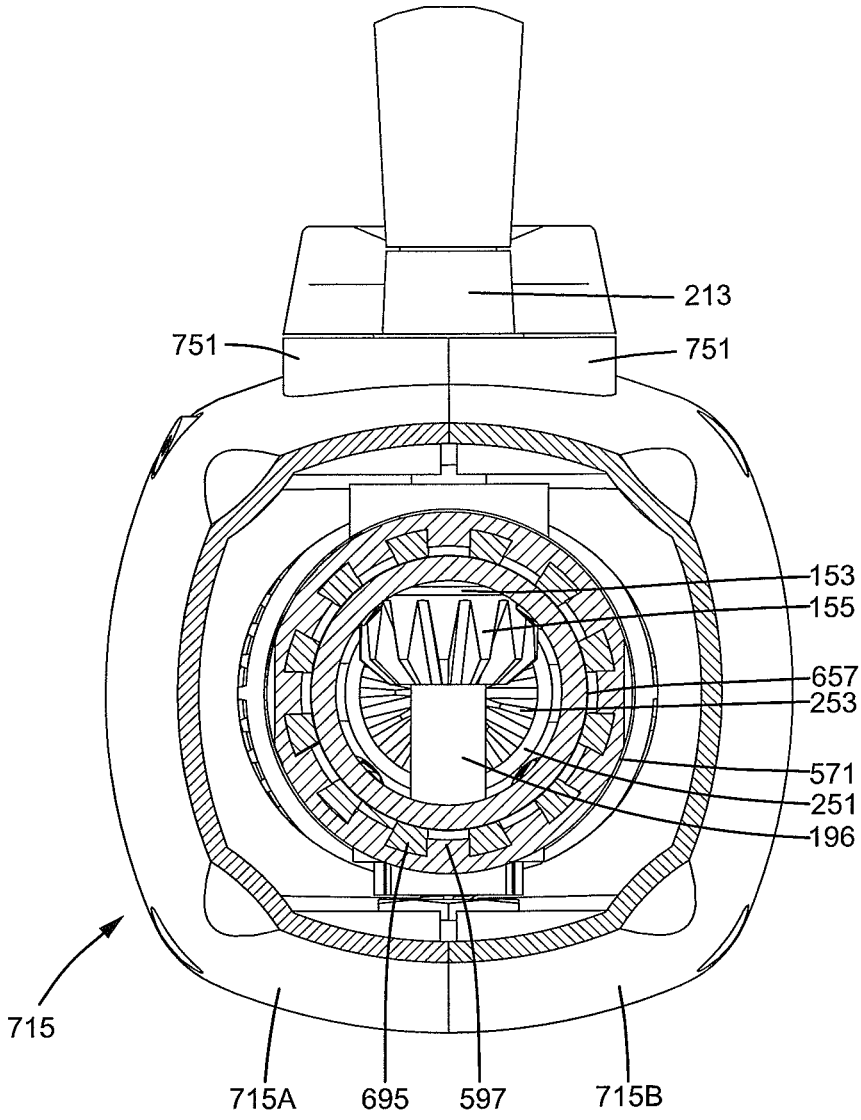
FIG. 4C shows a cross sectional view taken along section line 4C-4C of FIG. 4.

According to the form shown, an axle 196 has non-circular cross sections and includes a head 197 on an end thereof and a threaded portion 199 in the other end thereof, with threaded portion 199 having a groove 211. Axle 196 further includes a pin hole 198 between threaded portion 199 and head 197. Axle 196 is extended through axial hole 159 of first transmission member 151, with head 197 located outside of first opening 579 of control tube 571 (FIG. 4). Axle 196 is extended through second hole 139 of pole 111, second opening 591 of control tube 571, and pivot hole 173 of seat 171. Threaded portion 199 of axle 196 is located outside of control tube 571. A pin 200 is extended through pin hole 198 of axle 196 and engaged in pin groove 160 of first transmission member 151. A washer 175 and a nut 179 mounted around threaded portion 199 outside of seat 171. Thus, axle 196 and first transmission member 151 are jointly rotatable about a rotating axis defined by a longitudinal axis of axle 196 perpendicular to the longitudinal axis of pole 111. A ratchet wheel 177 is mounted around threaded portion 199 and sandwiched between washer 175 and nut 179. A pin 191 is extended through nut 179 and groove 211 in axle 196 (FIG. 4), preventing loosening of nut 179 during rotation of axle 196. Thus, axle 196 can not be disengaged from pole 111 in the radial direction. Furthermore, a catch 193 is fixed on seat 171 and releasably engaged with ratchet wheel 177.

According to the form shown, a handle 213 is mounted to axle 196. Handle 213 includes a coupling hole 215. Head 197 of axle 196 is engaged in coupling hole 215. Thus, handle 213, axle 196, and first transmission member 151 are jointly rotatable. A spring 162 is mounted around axle 196 and between flange 153 of first transmission member 151 and handle 213. Spring 162 biases flange 153 of first transmission member 151 to press against a face of washer 164.

According to the form shown, a housing 715 comprised of first and second housing halves 715A and 715B is mounted around pole 111 and surrounds first and second holes 137 and 139. Specifically, each of first and second housing halves 715A and 715B includes a lateral wall 717 having an upper portion 719 and a lower portion 731, defining upper and lower holes 733 and 735 and a pivotal portion 751 between upper and lower holes 733 and 735. A partitioning board 737 is formed on an inner face of lateral wall 717 of each of first and second housing halves 715A and 715B to separate an interior of each of first and second housing halves 715A and 715B into a movement space 739 and a mounting space 750.

Figure 2:
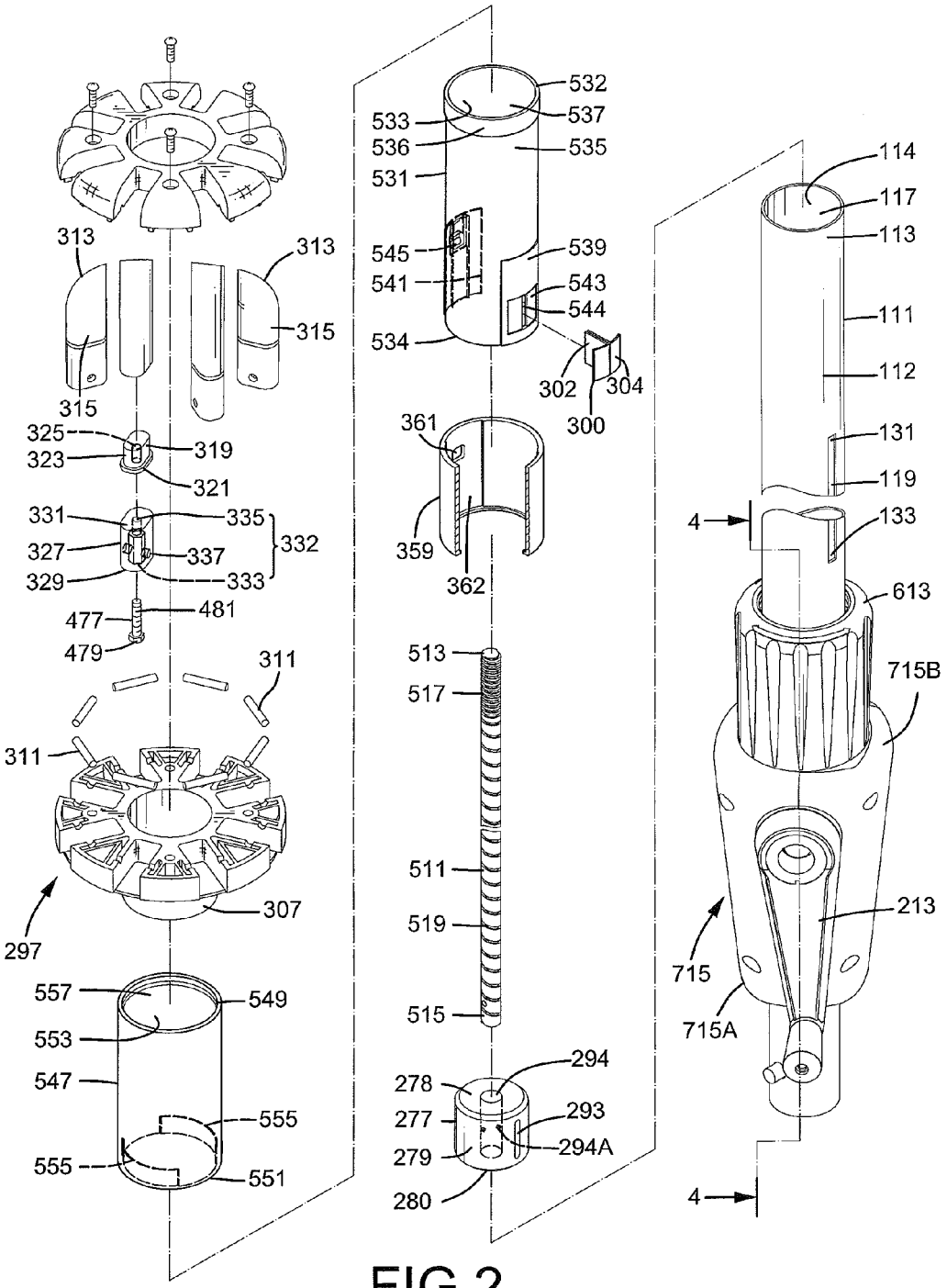
FIG. 2 shows a partial, exploded, perspective view of the rotatable sunshade of FIG. 1.
Figure 2A:
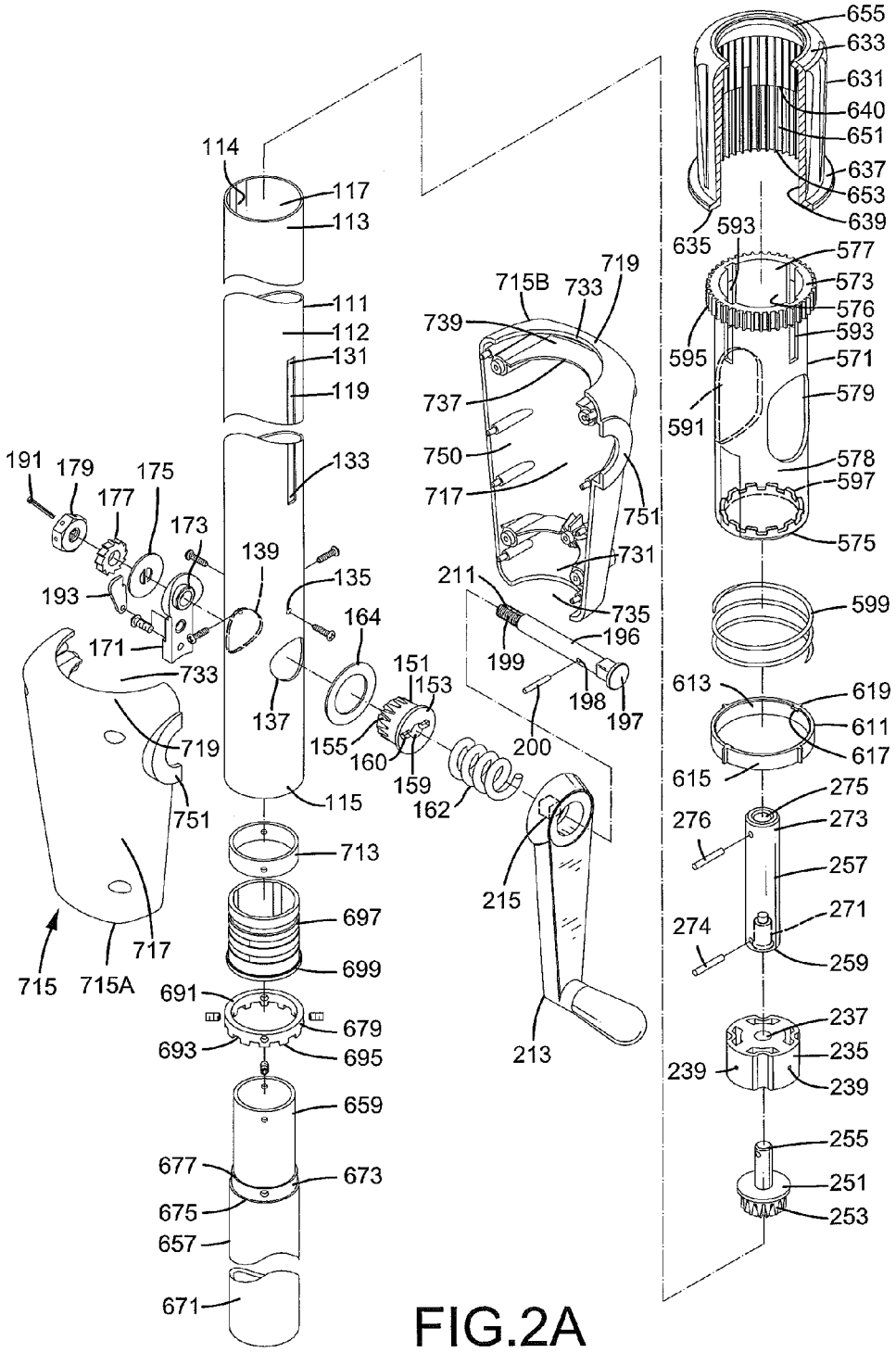
FIG. 2A shows another partial, exploded perspective view of the rotatable sunshade of FIG. 1.
Figure 3:
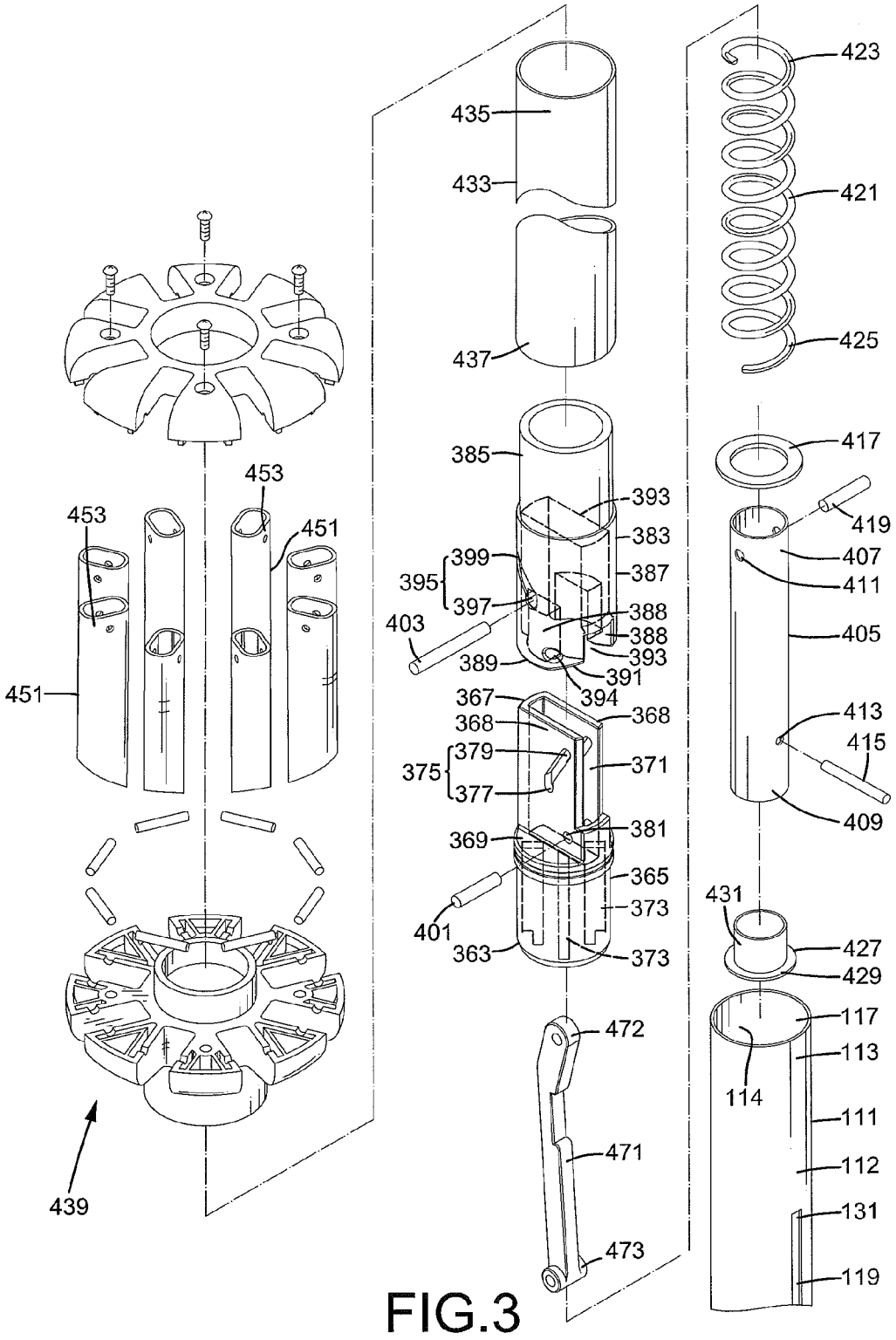
FIG. 3 shows a further partial, exploded, perspective view of the rotatable sunshade of FIG. 1.

First and second housing halves 715A and 715B are mounted around pole 111, with pole 111 extending through upper holes 733 and lower holes 735, with pivotal portions 751 aligned with first hole 137 of pole 111. Flange 637 of rotating sleeve 631 and retaining ring 611 are received in movement spaces 739 of first and second housing halves 715A and 715B and stopped by upper portions 719, preventing disengagement of rotating sleeve 631 from disengaging from housing 715 along pole 111. Control tube 571 is biased by spring 599 to the engagement position (FIG. 4). A lower end of retaining ring 611 abuts partitioning boards 737 of first and second housing halves 715A and 715B. Engagement end 575 of control tube 571, positioning ring 679, rotational tube 697, and first and third coupling sections 659 and 673 of connection tube 657 are received in mounting spaces 750 of first and second housing halves 715A and 715B. Rotating sleeve 631 extends out of first and second housing halves 715A and 715B via upper holes 733, such that upper end 633 of rotating sleeve 631 is located outside of housing 715 (FIGS. 2 and 4).

According to the form shown, a support 235 is fixed in longitudinal hole 117 of pole 111 and includes upper and lower faces spaced along the longitudinal axis of pole 111. A shaft hole 237 extends from the upper face through the lower face of support 235. Support 235 includes a plurality of fixing holes 239 aligned with through-holes 135 in pole 111. Screws are extended through through-holes 135 of pole 111 into fixing holes 239 of support 235, fixing support 235 in pole 111 in a location between second end 133 of slot 119 of pole 111 and first transmission member 151 (FIG. 4).

According to the form shown, a second transmission member 251 is rotatably supported by support 235. Second transmission member 251 includes a toothed portion 253 meshed with toothed portion 155 of first transmission member 151 and a shaft 255 rotatably extending through shaft hole 237, with a distal end of shaft 255 located outside of support 235. Thus, when first transmission member 151 rotates, second transmission member 251 rotates about the longitudinal axis of pole 111.

According to the form shown, a connecting member 257 is fixed to second transmission member 251. Connecting member 257 includes a first end 259 and a second end 273 spaced from first end 259 along the longitudinal axis of pole 111, with a first receptacle 271 defined in an end face of first end 259, with a second receptacle 275 defined in an end face of second end 273. The distal end of shaft 255 of second transmission member 251 is received in first receptacle 271. A first pin 274 is extended in a radial direction through first end 259 of connecting member 257 and the distal end of shaft 255. Thus, first end 259 of connecting member 257 is fixed to shaft 255, allowing joint rotation of connecting member 257 and second transmission member 251. Support 235 is located between second transmission member 251 and connecting member 257, preventing movement of second transmission member 251 and connecting member 257 along the longitudinal axis of pole 111.

According to the form shown, a screw rod 511 has a lower end 515 engaged in second receptacle 275 of connecting member 257, with a second pin 276 extending in a radial direction through second end 273 of connecting member 257 and lower end 515 of screw rod 511, allowing joint rotation of screw rod 511 and connecting member 257. Screw rod 511 further includes an upper end 513, with lower end 515 of screw rod 511 located between upper end 513 and support 235 along the longitudinal axis of pole 111. Screw rod 511 further includes a small pitch portion 517 at upper end 513 and a large pitch portion 519 extending from a lower end of small pitch portion 517 to lower end 515. Large pitch portion 519 has a pitch in a range between 7 mm and 12 mm. Small pitch portion 517 has a pitch in a range between 2 mm and 4 mm.

Figure 13:
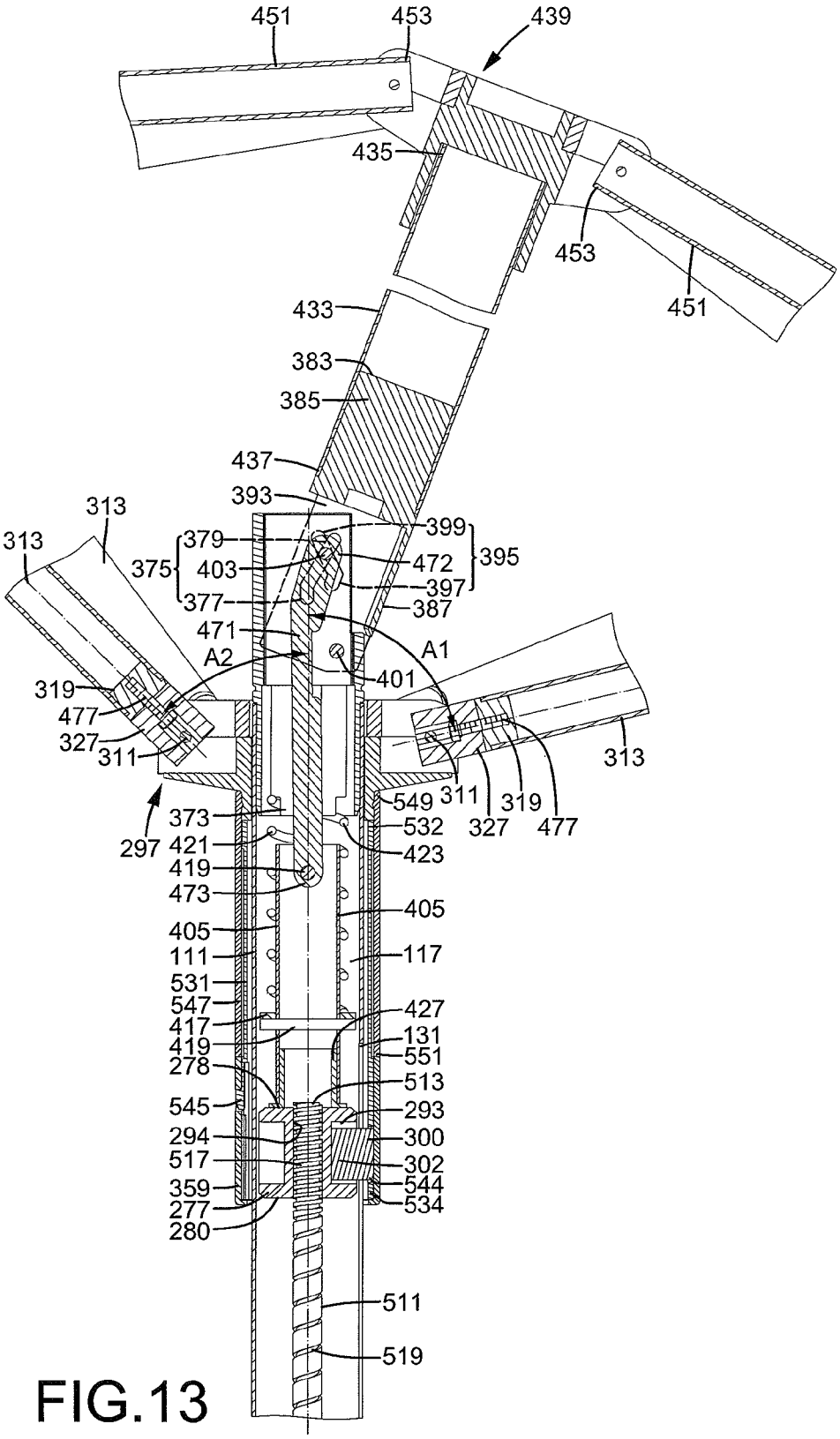
FIG. 13 shows a cross sectional view taken along section line 13-13 of FIG. 12.

According to the form shown, a follower 277 is threadedly engaged with screw rod 511. Follower 277 includes first and second faces 278 and 280 spaced from each other along the longitudinal axis of pole 111 and an outer periphery 279 extending between first and second faces 278 and 280. A hole 294 extends from first face 278 through second face 280. Two pegs 294A are formed on an inner periphery of hole 294. An engagement hole 293 is defined in outer periphery 279 but spaced from hole 294. Screw rod 511 extends through hole 294 of follower 277, with pegs 294A engaged in a valley of one of small pitch portion 517 and large pitch portion 519. Rotation of screw rod 511 causes movement of follower 27 along the longitudinal axis of pole 111 between a folded position (FIG. 5), an unfolded position (FIG. 11), and a tilted position (FIG. 13). A first spacing between follower 277 in the folded position and second transmission member 251 along the longitudinal axis of pole 111 is smaller than a second spacing between follower 277 in the unfolded position and second transmission member 251 along the longitudinal axis of pole 111. The second spacing between follower 277 in the unfolded position and second transmission member 251 is smaller than a third spacing between follower 277 in the tilted position and second transmission member 251 along the longitudinal axis of pole 111.

A length of large pitch portion 519 along the longitudinal axis of pole 111 is slightly larger than travel of follower 277 from the folded position to the unfolded position. A length of small pitch portion 517 along the longitudinal axis of pole 111 is slightly larger than travel of follower 277 from the unfolded position to the tilted position.

According to the form shown, a receiving tube 531 is mounted around pole 111 and slideable relative to pole 111 along the longitudinal axis of pole 111. Receiving tube 531 includes a top end 532 and a bottom end 534. Receiving tube 531 further includes inner and outer peripheries 533 and 535 extending between top and bottom ends 532 and 534, with inner periphery 533 spaced from outer periphery 535 in the radial direction, and with inner periphery 533 defining a longitudinal hole 537. A flange 536 is formed on outer periphery 535 and located on top end 532. First and second protruded portions 539 and 541 are formed on outer periphery 535 and located at bottom end 534. An engagement groove 543 is defined in first protruded portion 539 and has a bottom wall spaced from inner periphery 533. A slot 544 extends from the bottom wall of engagement groove 543 through inner periphery 533 of receiving tube 531. A retaining portion 545 is formed on second protruded portion 541. Longitudinal hole 537 of receiving tube 531 receives pole 111, with slot 544 of receiving tube 531 aligned with slot 119 of pole 111.

Figure 5:
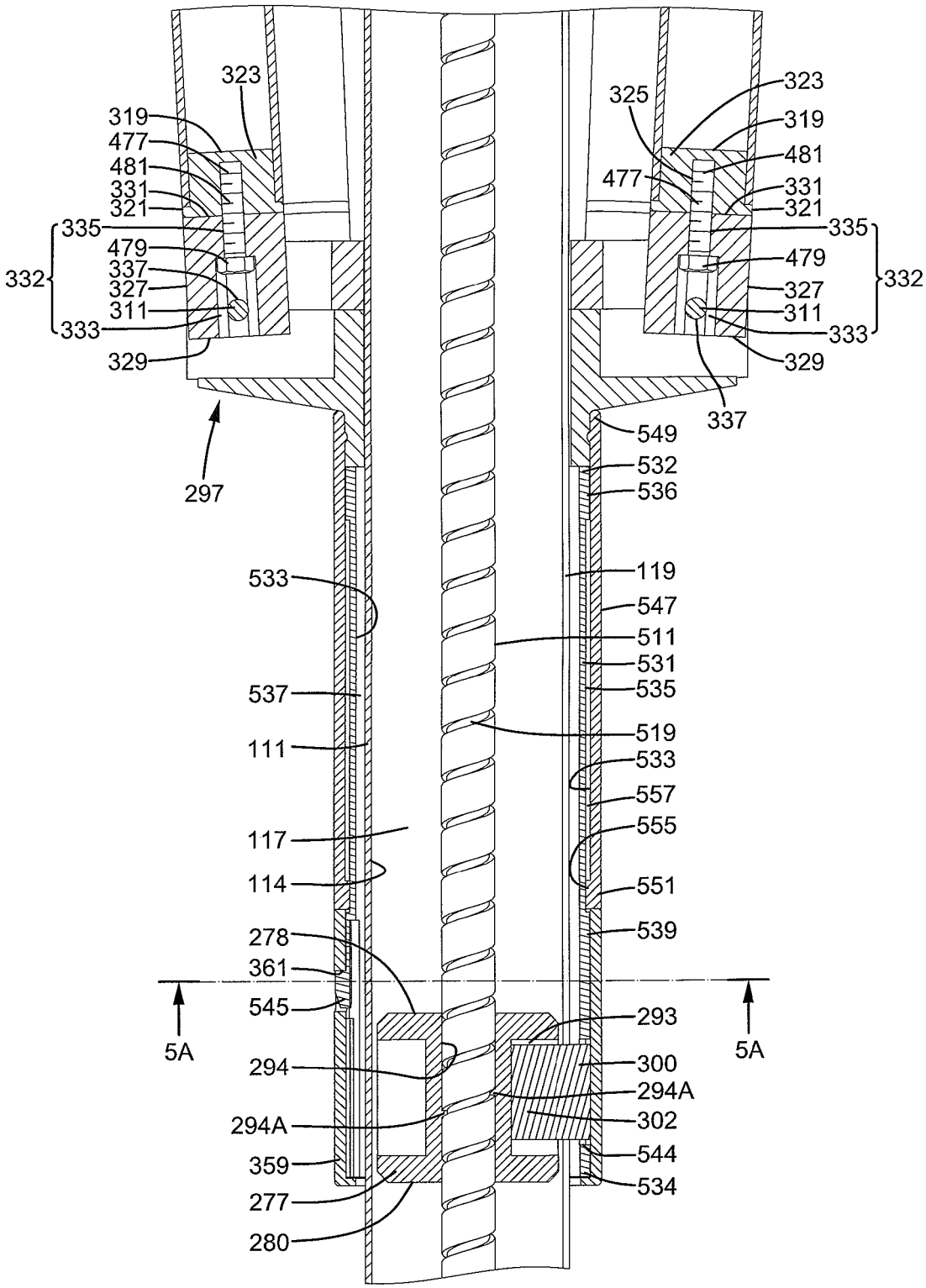
FIG. 5 shows a cross sectional view taken along section line 5-5 of FIG. 1.
Figure 5A:
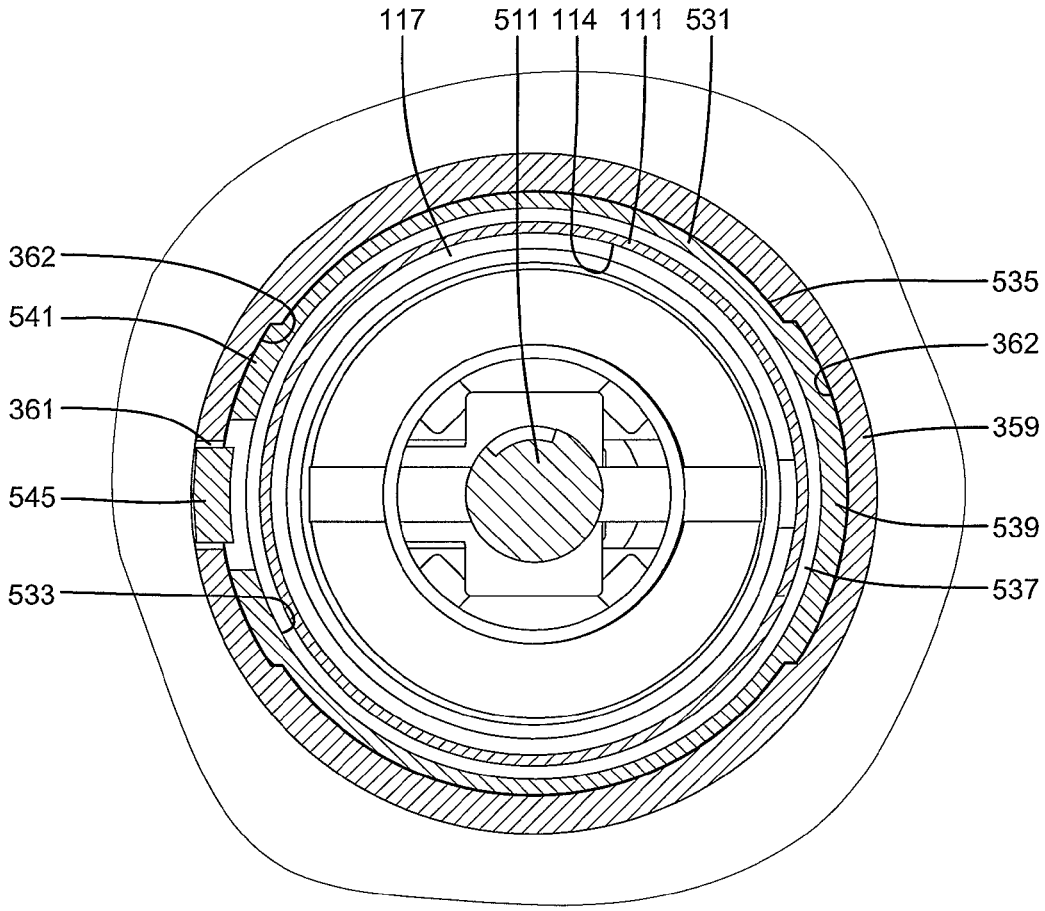
FIG. 5A shows a cross sectional view taken along section line 5A-5A of FIG. 5.

According to the form shown, an engagement member 300 is mounted in engagement groove 543 of receiving tube 531. Engagement member 300 includes a body 304 received in engagement groove 543 and an insertion portion 302 extending from body 304. Insertion portion 302 extends through slot 544 of receiving tube 531 and slot 119 of pole 111 and engages with engagement hole 293 of follower 277. Thus, receiving tube 531 and follower 277 are jointly movable between the folded position, the unfolded position, and the tilted position. Engagement member 300 prevents rotation of follower 277 relative to pole 111, such that rotation of screw rod 511 merely causes movement of follower 277 along the longitudinal axis of pole 111. A fixing sleeve 359 is mounted around bottom end 534 of receiving tube 531 and includes two sliding grooves 362 in an inner periphery thereof, with a retaining hole 361 extending from a bottom wall of one of sliding grooves 362 through an outer periphery of fixing sleeve 359. Retaining portion 545 of receiving tube 531 is engaged in retaining hole 361 (FIG. 5). First and second protruded portions 539 and 541 are received in sliding grooves 362 (FIG. 5A), preventing engagement member 300 from disengaging from engagement hole 293 of follower 277.

According to the form shown, a sliding sleeve 547 includes an abutment end 549 and a positioning end 551 spaced from abutment end 549 along the longitudinal axis of pole 111. Sliding sleeve 547 further includes an inner periphery 553 extending between abutment end 549 and positioning end 551 and defining a sliding hole 557. Two inner protruded portions 555 are formed on inner periphery 553 and located at positioning end 551. Receiving tube 531 is slideably received in sliding hole 557 of sliding sleeve 547. Positioning end 551 of sliding sleeve 547 abuts an upper end of fixing sleeve 359. Each inner protruded portion 555 is located between flange 536 of receiving tube 531 and fixing sleeve 359. Thus, each inner protruded portion 555 is movable between flange 536 of receiving tube 531 and fixing sleeve 359 when sliding sleeve 547 moves in the longitudinal axis of pole 111.

According to the form shown, a runner 297 is mounted around pole 111 and slideable relative to pole 111 along the longitudinal axis of pole 111. Runner 297 includes a lower end 307 and a plurality of pivotal pins 311 spaced in a circumferential direction about the longitudinal axis of pole 111. Lower end 307 of runner 297 is securely received in a top end of sliding sleeve 547. Lower end 307 of runner 297 abuts top end 532 of receiving tube 531 when positioning end 551 of sliding sleeve 547 abuts the upper end of fixing sleeve 359. Thus, runner 297, receiving tube 531, fixing sleeve 359, engagement member 300, and follower 277 move jointly between the folded position, the unfolded position, and the tilted position by operating handle 213. When sliding sleeve 547 moves between flange 536 of receiving tube 531 and fixing sleeve 359, runner 297 moves jointly with sliding sleeve 547.

According to the form shown, a pivotal seat 327 is pivotably connected to each pivotal pin 311. Each pivotal seat 327 includes a first surface 329 and a second surface 331 opposite to first surface 329, with a mounting hole 332 extending from first surface 329 through second surface 331. Mounting hole 332 includes a larger hole section 333 in first surface 329 and a smaller hole section 335 in second surface 331, with larger hole section 333 having non-circular cross sections. Each pivotal seat 327 further includes a pivotal hole 337 extending perpendicularly to and intersecting with larger hole section 333. Each pivotal pin 311 is received in pivotal hole 337 of one of pivotal seats 327, allowing pivotal seat 327 to pivot about a pivot axis defined by pivotal pin 311.

According to the form shown, a screw 477 is mounted in mounting hole 332 of each pivotal seat 327 and includes a head 479 having non-circular cross sections the same as those of larger hole section 333 and includes a shank 481 having an outer thread. Head 479 of each screw 477 is received in larger hole section 333 of one of pivotal seats 327, preventing screw 477 from rotating relative to pivotal seat 327. Shank 481 extends through smaller hole section 335 and extends out of pivotal seat 327. After installation, each screw 477 is spaced from a corresponding pivotal pin 311 along the longitudinal axis of pole 111 (FIG. 5).

According to the form shown, a plug 319 is threadedly engaged with shank 481 of each screw 477 extending beyond pivotal seat 327. Each plug 319 includes a coupling portion 323, with a flange 321 formed on a side of coupling portion 323, and with a screw hole 325 defined in the side of coupling portion 323 and surrounded by flange 321. Shank 481 of each screw 477 is loosely engaged in screw hole 325 of one of plugs 319, allowing each plug 319 to pivot about a pivot axis defined by screw 477 while preventing plug 319 from disengaging from screw 477.

According to the form shown, a stretcher 313 is connected to each plug 319. Each stretcher 313 includes a first end 315 securely receiving coupling portion 323 of one of plugs 319, allowing each stretcher 313 and the corresponding pivotal seat 327 to pivot about the pivot axis defined by a corresponding pivotal pin 311. Furthermore, each plug 319 and the corresponding stretcher 313 are jointly pivotable about the pivot axis defined by the corresponding screw 477. Furthermore, each stretcher 313 is jointly movable together with runner 297 and follower 277 between the folded position, the unfolded position, and the tilted position. Each stretcher 313 further has a second end 317.

According to the form shown, a fixing member 363 is mounted to upper end 113 of pole 111 and includes a receiving section 365 having circular cross sections and a pivotal section 367, with pivotal section 367 having substantially U-shaped cross sections and having two sidewalls 368. A shoulder 369 is formed on an intersection of receiving section 365 and pivotal section 367. Fixing member 363 includes a compartment 371 extending from receiving section 365 through pivotal section 367, with compartment 371 located between two sidewalls 368 of pivotal section 367. Each sidewall 368 includes a sliding groove 375 in communication with compartment 371. Sliding groove 375 of each sidewall 368 includes a first section 377 parallel to the longitudinal axis of pole 111 and a second section 379 at an obtuse angle (about 150° in the form shown, see FIG. 6) to first section 377. Each sidewall 368 further includes a pin hole 381 located between sliding groove 375 and receiving section 365. A plurality of abutment protrusions 373 is defined in compartment 371 in receiving section 365. Receiving section 365 of fixing member 363 is fixed in longitudinal hole 117 at upper end 113 of pole 111.

According to the form shown, a pivotable member 383 is pivotably mounted to pivotal section 367 of fixing member 363. Pivotable member 383 includes an engaging portion 385 and a pivotal portion 387. Pivotal portion 387 includes a lower end having a lower end face 389 and an abutment face 391 at an obtuse angle (about 159° in the form shown, see FIG. 6) to lower end face 389. Pivotal portion 387 further includes two lateral walls 388 spaced from each other in a direction perpendicular to the longitudinal axis of pivotable member 383. A receiving space 393 is defined in lower end face 389 and located between lateral walls 388 of pivotal portion 387. Each lateral wall 388 includes a track 395 extending into receiving space 393 in the radial direction, with track 395 having a first track section 397 and a second track section 399 at an obtuse angle (about 135° in the form shown, see FIG. 6) to first track section 397. Each lateral wall 388 further includes a pivot hole 394 located between track 395 and lower end face 389. Pivotal section 367 of fixing member 363 is received in receiving space 393 of pivotable member 383, with sidewalls 368 of fixing member 363 located between lateral walls 388 of pivotable member 383. Pivot holes 394 of pivotable member 383 are aligned with pin holes 381 of fixing member 363. Lower end face 389 of pivotable member 383 is spaced from shoulder 369 of fixing member 363 along the longitudinal axis of pole 111.

According to the form shown, a pin 401 is extended through pivot holes 394 of pivotable member 383 and pin holes 381 of fixing member 363, allowing pivotable member 383 to pivot about a pivot axis defined by pin 401 between a first position (FIGS. 1, 6, 10, and 11) and a second position (FIGS. 12 and 13) in a pivotal movement plane, with the pivotal movement plane being perpendicular to the pivot axis defined by pin 401 and including the longitudinal axis of pivotable member 383. When pivotable member 383 is in the first position (see FIG. 6), first track sections 397 of tracks 395 of pivotable member 383 are aligned with first sections 377 of sliding grooves 375 of fixing member 363. Furthermore, the longitudinal axis of pivotable member 383 is coaxial to the longitudinal axis of pole 111. Abutment face 391 of pivotable member 383 provides room for the pivotal movement of pivotable member 383 from the first position to the second position. While pivotable member 383 is moving from the first position to the second position, lower end face 389 of pivotable member 383 does not interfere with shoulder 369 of fixing member 363. On the other hand, when pivotable member 383 is in the second position, abutment face 391 of pivotable member 383 is substantially parallel to shoulder 369 of fixing member 363 (FIG. 13). In the form shown, an extension tube 433 includes a lower end 437 fixed to engaging portion 385 of pivotable member 383 and an upper end 435.

Figure 6:
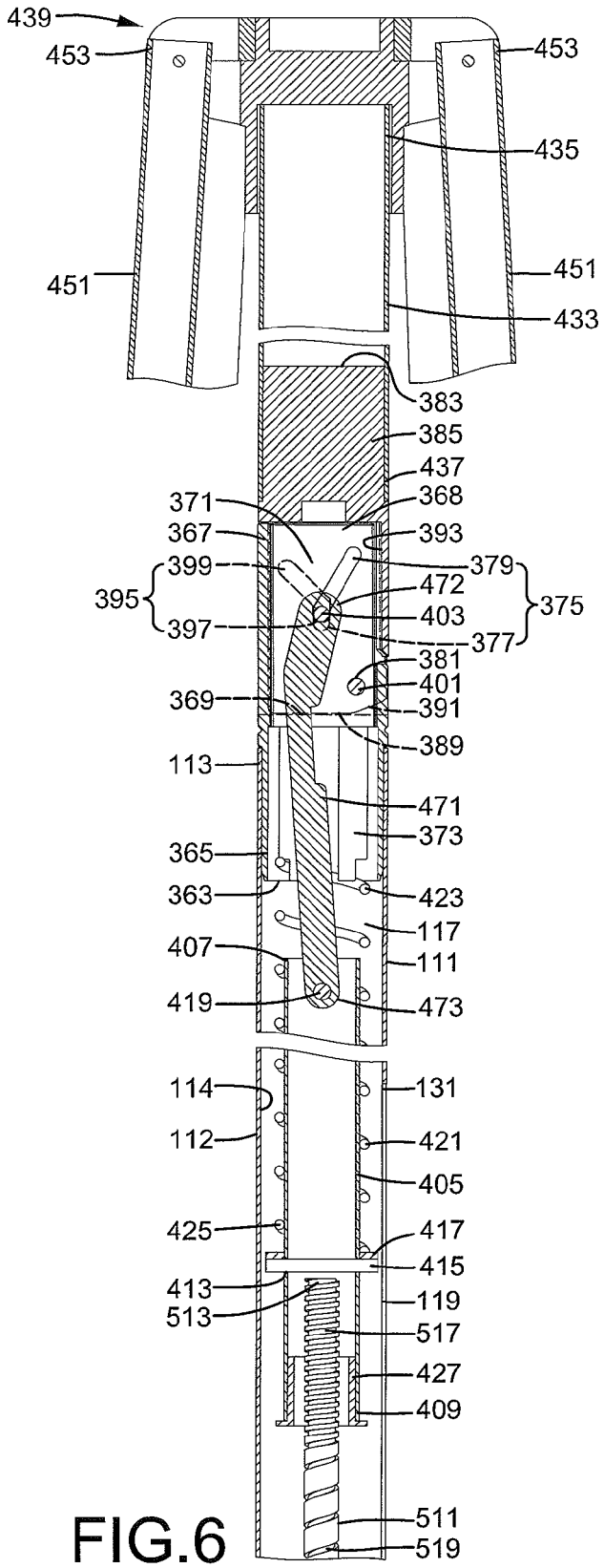
FIG. 6 shows a cross sectional view taken along section line 6-6 of FIG. 1.

According to the form shown, an actuation rod 403 is slideably received in tracks 395 of pivotable member 383 and sliding grooves 375 of fixing member 363. When pivotable member 383 is in the first position, actuation rod 403 is in first track sections 397 of tracks 395 of pivotable member 383 and first sections 377 of sliding grooves 375 of fixing member 363 (FIG. 6).

According to the form shown, a link 471 includes a first connection end 472 connected to actuation rod 403 and a second connection end 473. First connection end 472 is received in compartment 371 of fixing member 363. Second connection end 473 of link 471 is located in longitudinal hole 117 of pole 111. A connection member 405 includes a first end 407 pivotably connected to second connection end 473 of link 471 and a second end 409 below first end 407. Connection member 405 includes aligned first positioning holes 411 defined in first end 407 and aligned second positioning holes 413 between second end 409 and first positioning holes 411. A pin 419 is extended through first positioning holes 411 of first end 407 of connection member 405 and second connection end 473 of link 471. Thus, link 471 is pivotably connected to connection member 405. Upper end 513 of screw rod 511 is received in connection member 405. A positioning pin 415 is extended through second positioning holes 413 of connection member 405 in a radial direction perpendicular to the longitudinal axis of pole 111, with two ends of positioning pin 415 located outside of connection member 405.

According to the form shown, an abutment member 417 is annular and rests on exposed ends of positioning pin 415. A cap 427 includes a tubular portion 431 engaged in second end 409 of connection member 405. A flange 429 is formed on a lower side of tubular portion 431 and abuts an end face of second end 409 of connection member 405. A spring 421 is mounted around connection member 405 and includes a first end 423 abutting lower ends of abutment protrusions 373 of fixing member 363. Spring 421 further includes a second end 425 abutting abutment member 417. Spring 421 biases connection member 405 to retain pivotable member 383 in the first position (FIG. 6).

According to the form shown, a hub 439 is fixed on upper end 435 of extension tube 433. Pivotable member 383, extension tube 433 and hub 439 are jointly moveable between the first and second positions about the pivot axis defined by pin 401. A plurality of ribs 451 is provided, with each rib 451 including a connecting end 453 pivotably connected to hub 439 (FIG. 6), with second end 317 of each stretcher 313 pivotably connected to one of ribs 451. A canopy 475 is mounted to ribs 451.

Figure 7:
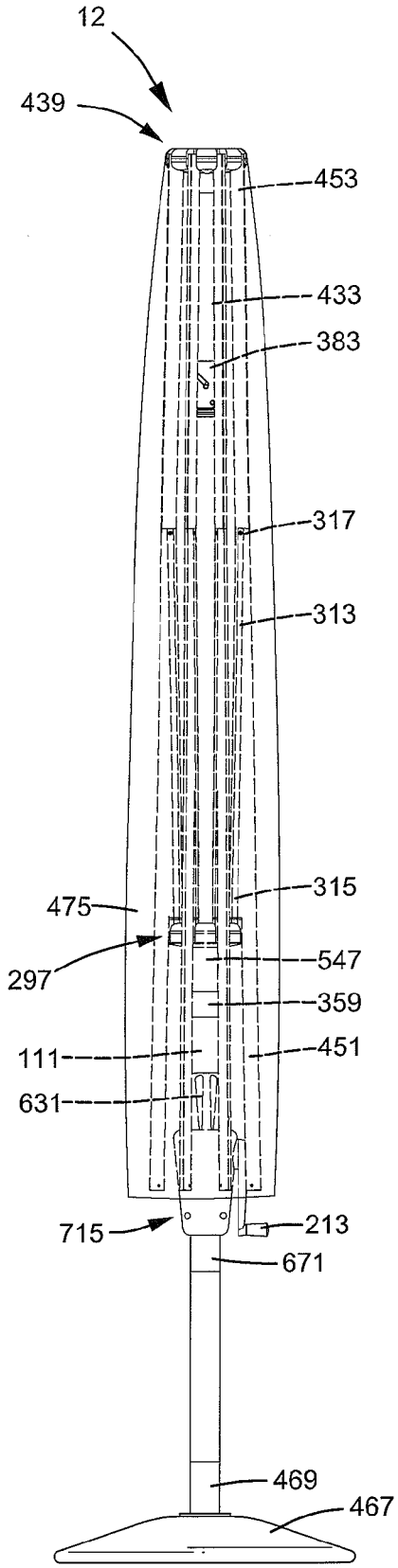
FIG. 7 shows a left side view of the rotatable sunshade of FIG. 1.

Now that the basic construction of rotatable sunshade 12 of the present invention has been explained, the operation and some of the advantages of rotatable sunshade 12 can be set forth and appreciated. In particular, for the sake of explanation, it will be assumed that follower 277 of rotatable sunshade 12 is located in the folded position (FIG. 5). Positioning end 551 of sliding sleeve 547 abuts the upper end of fixing sleeve 359, preventing runner 297 from moving away from hub 439. Follower 277 is spaced from cap 427 along the longitudinal axis of pole 111 and around large pitch portion 519 of screw rod 511. Engagement member 300 is adjacent to second end 133 of slot 119. Runner 297 is adjacent to housing 715 (FIG. 1). The longitudinal axis of pivotable member 383 is coaxial to the longitudinal axis of pole 111, such that extension tube 433 is coaxial to and aligned with pole 111. Each of ribs 451 and stretchers 313 is in the folded state and located adjacent to pole 111 so that canopy 475 is in a collapsed state. The distal ends of some ribs 451 are located in a rotating path of handle 213 (FIG. 7). Spring 421 biases pivotable member 383 to the first position (FIG. 6). Control tube 571 is biased by spring 599 to the engagement position. Inner teeth 597 of control tube 571 engage with teeth 695 of positioning ring 679. Thus, pole 111 is positioned and can not rotate about the longitudinal axis of pole 111.

Note that when follower 277 is in the folded position, inner protruded portion 555 of the receiving tube 531 is spaced from flange 536 of receiving tube 531. If sliding sleeve 54 moves along the longitudinal axis of pole 111 towards hub 439 and pushes runner 297 while follower 277 is in the folded position, flange 536 of receiving tube 531 is in a movement path of inner protruded portions 555 of receiving tube 531, preventing sliding sleeve 547 from being disengaged from receiving tube 531.

Figure 8:
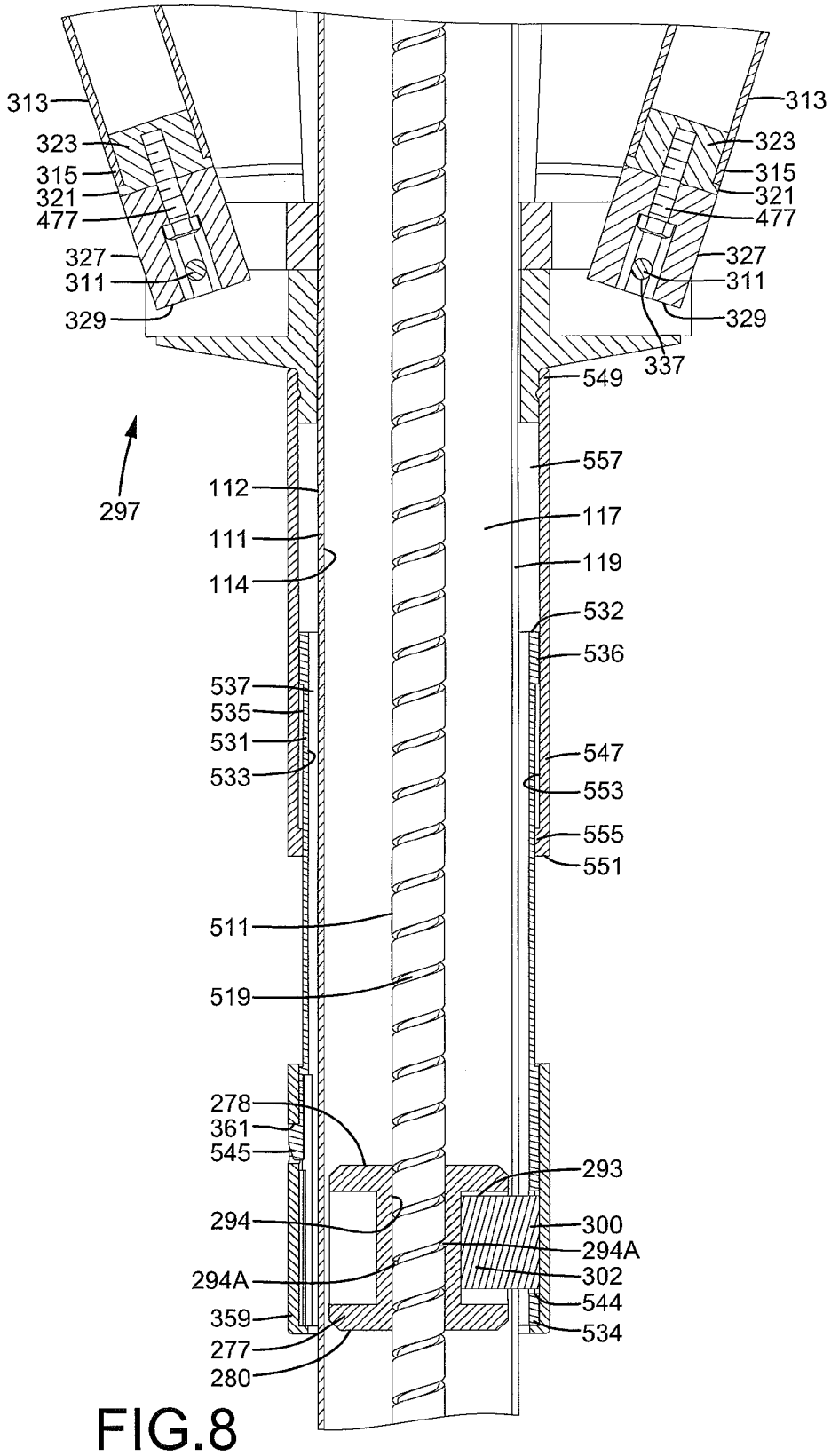
FIG. 8 shows a view similar to FIG. 5, with a sliding sleeve and a runner moved.

Before unfolding rotatable sunshade 12, one of ribs 451 is pulled or sliding sleeve 547 is moved towards hub 439 along the longitudinal axis of pole 111, such that runner 297 is moved through a small distance towards hub 439 without moving receiving tube 531, follower 277, and engagement member 300 (FIG. 8). Thus, each rib 451 is located outside of the rotating path of handle 213 (FIG. 9), allowing smooth rotation of handle 213 for opening rotatable sunshade 12.

Figure 9:
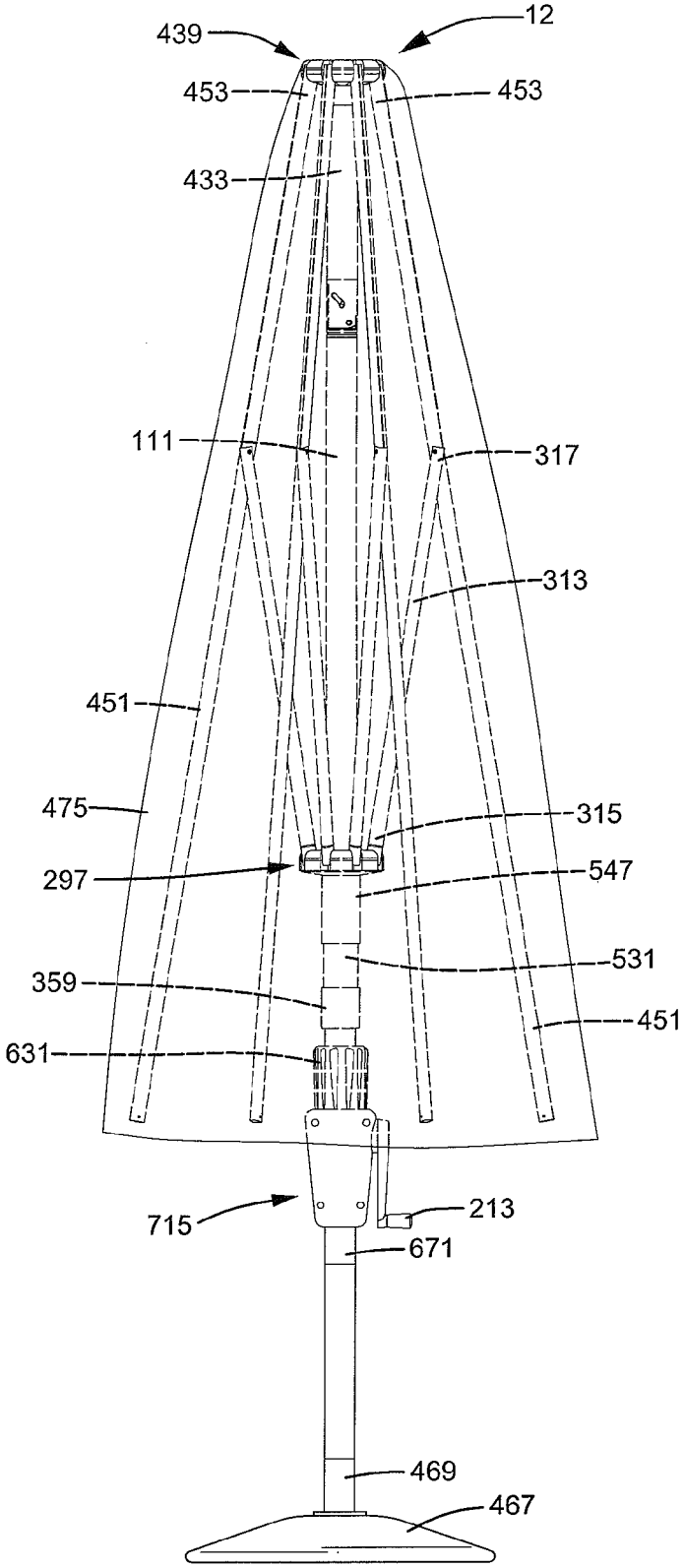
FIG. 9 shows a view similar to FIG. 7, with the sliding sleeve and the runner moved.
Figure 10:
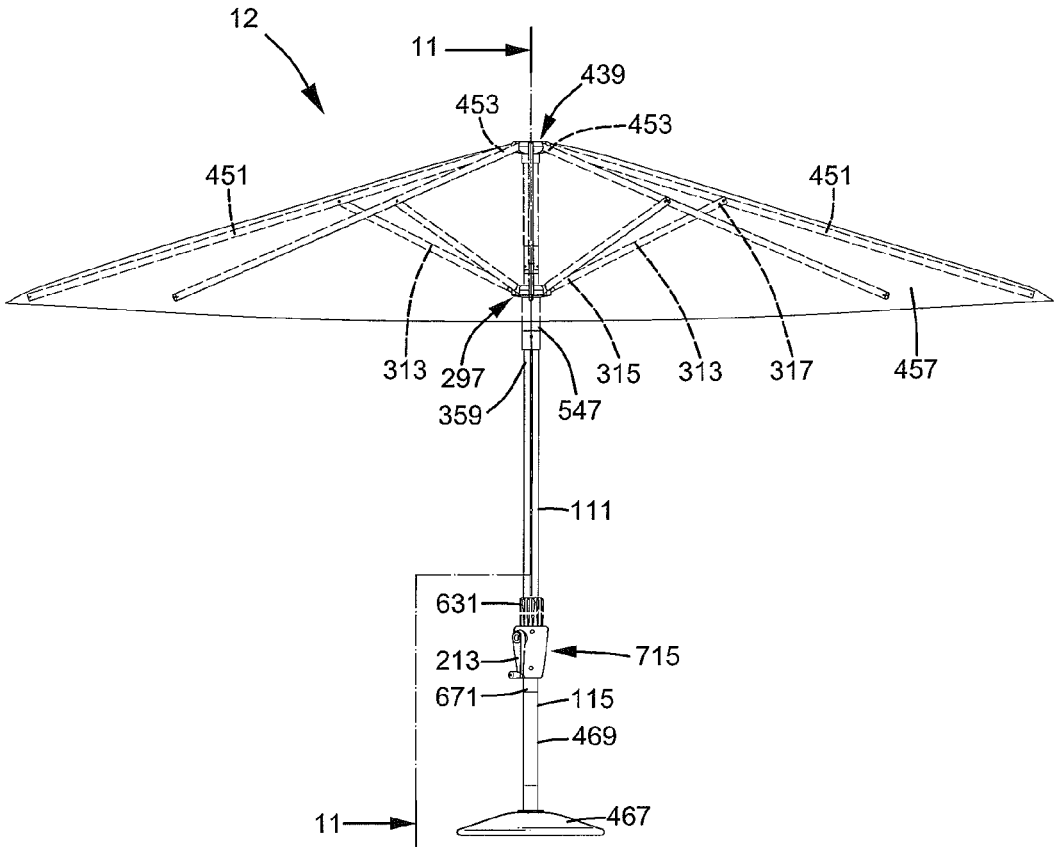
FIG. 10 shows a side elevational view of the rotatable sunshade in an unfolded state.
Figure 11:
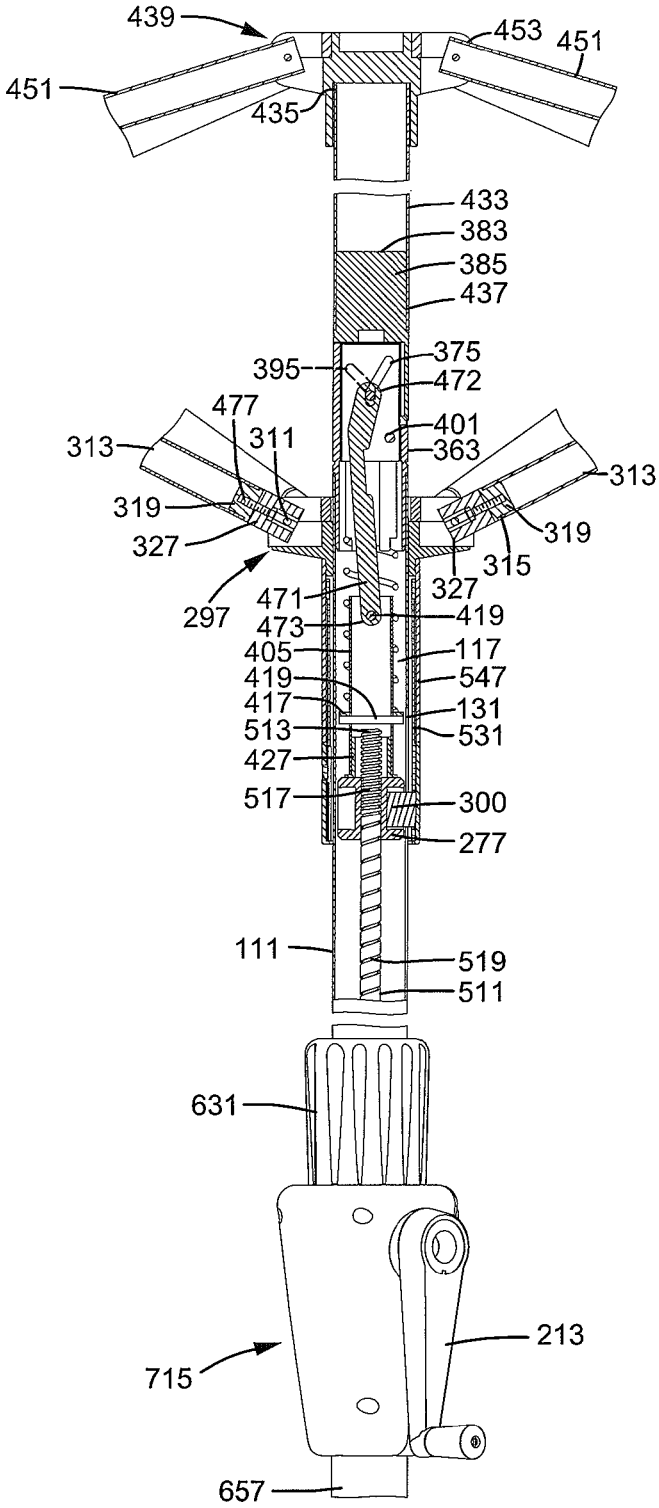
FIG. 11 shows a cross sectional view taken along section line 11-11 of FIG. 10.

When it is desired to open rotatable sunshade 12 in the state shown in FIG. 9, handle 213 is rotated in a direction to rotate axle 196 and first transmission member 151, causing rotation of second transmission member 251 via transmission by toothed portions 155 and 253, which, in turn, causes rotation of connecting member 257 and screw rod 511. Follower 277 moves from the folded position (FIG. 8) to the unfolded position (FIG. 11). Specifically, engagement member 300 pushes receiving tube 531 to move runner 297 towards hub 439, moving stretchers 313 and ribs 451 to extend canopy 475. Since follower 277 is around the large pitch portion 519 of screw rod 511, rotation of screw rod 511 causes follower 277 to move rapidly from the folded position to the unfolded position at a first speed, with pegs 294A moving in the valley of large pitch portion 519. When follower 277 reaches the unfolded position (FIG. 11), first face 278 of follower 277 abuts flange 429 of cap 427, follower 277 is in a location around an intersection between large pitch portion 519 and smaller pitch portion 517, and runner 297 is in a location adjacent to fixing member 363 and below pin 401. Canopy 475 is extended by ribs 451 and stretchers 313. Rotatable sunshade 12 is, thus, opened.

Figure 12:
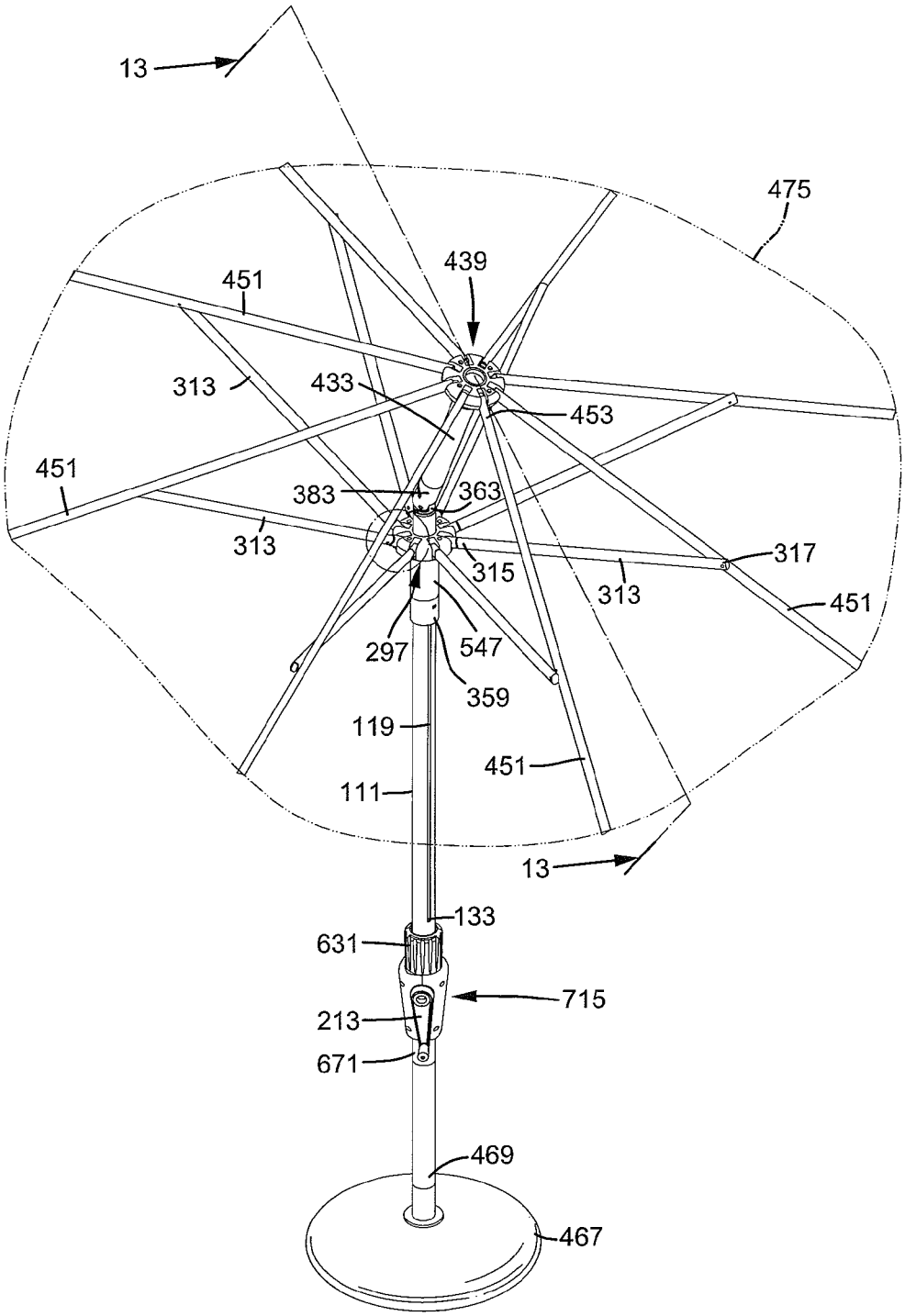
FIG. 12 shows a perspective view of the rotatable sunshade of FIG. 1, with the sunshade in a tilted state.

In a case that handle 213 is further rotated in the same direction while rotatable sunshade 12 is in the open state, follower 277 moves from the unfolded position to the tilted position (FIG. 12). Specifically, follower 277 is slowly moved by small pitch portion 517 of the rotating screw rod 511 at a second speed while pegs 294A move in the valley of small pitch portion 517, with the second speed being smaller than the first speed. Follower 277 pushes cap 427, connection member 405, pin 419, positioning pin 415, and abutment member 417 to move along the longitudinal axis of pole 111 and compresses spring 421. First connection end 472 of link 471 pushes actuation rod 403 to move from first sections 377 of sliding grooves 375 of fixing member 363 into second sections 379. Actuation rod 403 presses against wall faces of tracks 395 of pivotable member 383 to pivot pivotable member 383 in the pivotal movement plane from the first position to the second position, leading to pivotal movement of extension tube 433, hub 439, and ribs 451 to a position in which extension tube 433 is at an obtuse angle to pole 111. Each stretcher 313 and the corresponding plug 319 move together with ribs 451 and, thus, pivot about the pivot axis defined by the corresponding pivotal pin 311. As a result, pivotable member 383 carries hub 439, extension tube 433, and ribs 451 to the second position (FIGS. 12 and 13). When pivotable member 383 reaches the second position, abutment face 391 is substantially parallel to shoulder 369 of fixing member 363, and runner 297 is still located below pin 401 along the longitudinal axis of pole 111. Canopy 475 is, thus, tilted. Pole 111 can be rotated relative to base 467 according to the position of the sun, providing desired shielding effect.

Figure 12A:
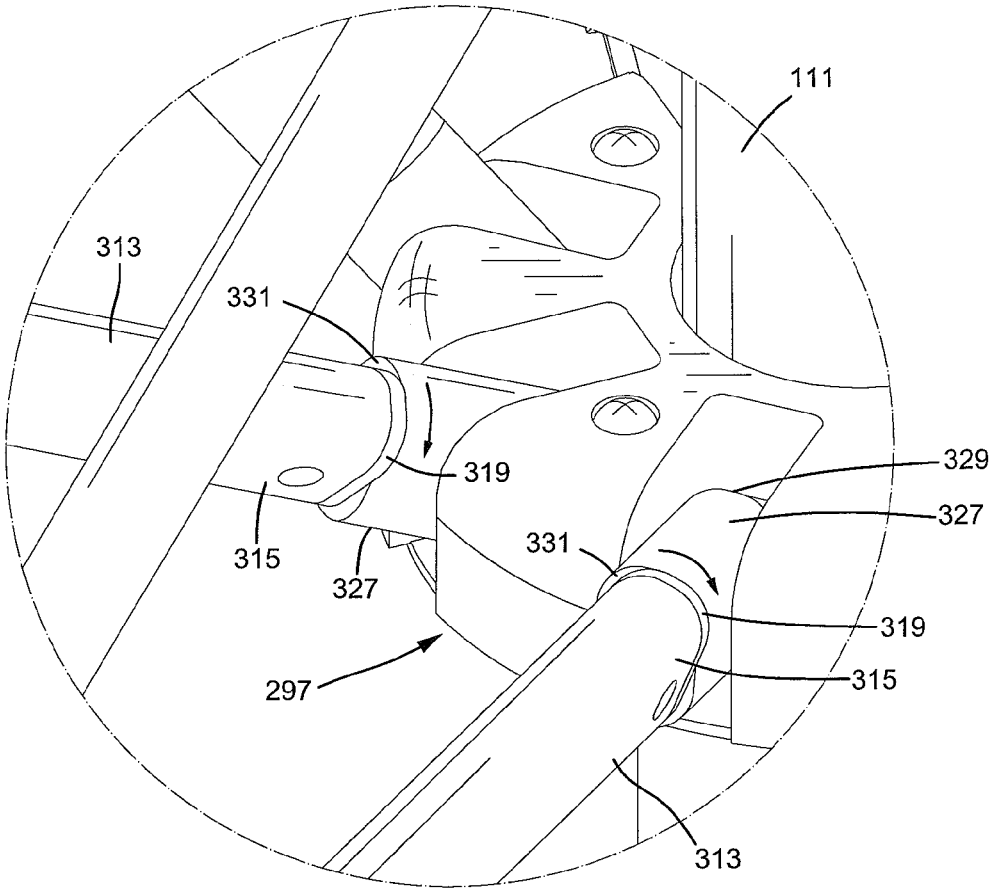
FIG. 12A shows an enlarged view of a circled portion of FIG. 12.

For stretchers 313 whose longitudinal axes are not located in the pivotal movement plane, each of these stretcher 313 not only pivots in the pivotal movement plane together with the corresponding rib 451 but also pivots about its longitudinal axis, as indicated by the arrows in FIG. 12A. Namely, each of these stretcher 313 pivots about the corresponding pivotal pin 311 and pivots about the corresponding screw 477. However, a stretcher 313 whose longitudinal axis is located in the pivotal movement plane will only pivot in the pivotal movement plane together with the corresponding rib 451 without pivotal movement about the corresponding screw 477. FIG. 13 shows movement of two stretchers 313 whose longitudinal axes are located in the pivotal movement plane. If pivotable member 383 is moved to the position shown in FIG. 13 in which the longitudinal axis of pivotable member 383 is at about 21° to the longitudinal axis of pole 111, the angle A2 between the longitudinal axis of the left stretcher 313 in FIG. 13 and the longitudinal axis of pole 111 is about 46°. Furthermore, the angle A1 between the longitudinal axis of the right stretcher 313 in FIG. 13 and the longitudinal axis of pole 111 is about 77°. Note that each of the stretchers 313 in FIG. 13 does not pivot about the corresponding screw 477.

With rotatable sunshade 12 in the tilted state shown in FIG. 13 and if handle 213 is rotated in a reverse direction, follower 277 is driven by small pitch portion 517 of screw rod 511 to move slowly from the tilted position to the unfolded position along the longitudinal axis of pole 111, and spring 421 presses against abutment member 417, causing positioning pin 415, connection member 405, pin 419, link 471, and actuation rod 403 to move jointly along the longitudinal axis of pole 111 in a direction releasing spring 421. Actuation rod 403 presses against the wall faces of second track sections 399 of tracks 395 of pivotable member 383, causing pivotal movement of pivotable member 383 from the second position to the first position (FIG. 11). Further rotation of handle 213 in the reverse direction causes movement of follower 277 from the unfolded position to the folded position. Runner 297 and stretchers 313 move to their original positions shown in FIG. 1. Rotatable sunshade 12 is, thus, folded.

Figure 15:
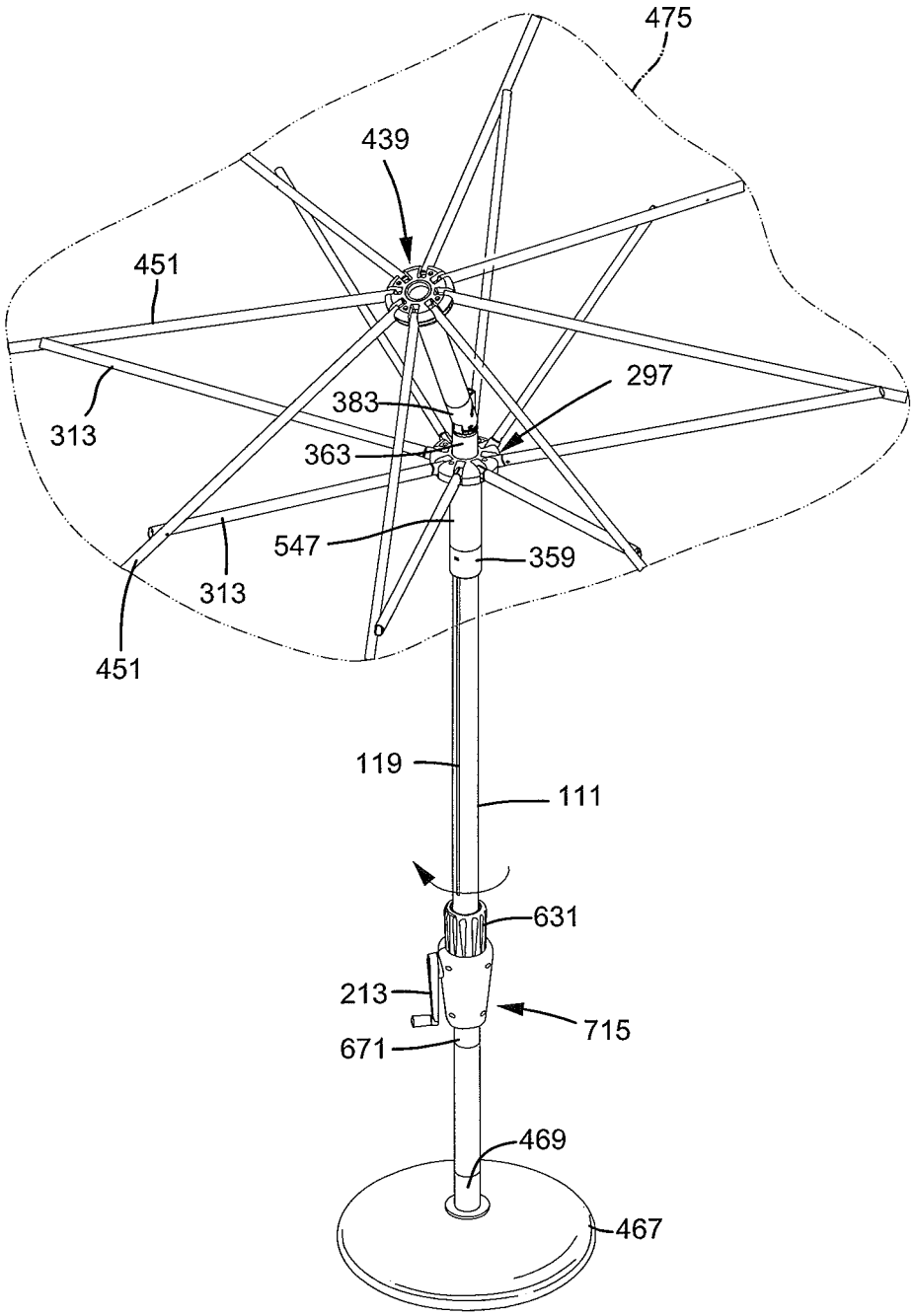
FIG. 15 shows a view similar to FIG. 12, with the control tube moved to the disengagement position and with a pole rotated.

If canopy 475 in the tilted state can not provide the desired sun-shielding effect, rotating sleeve 631 can be moved along the longitudinal axis of pole 111 away from hub 439 to move control tube 571 from the engagement position (FIG. 4) to the disengagement position (FIG. 14) by abutment wall 640. During movement from the engagement position to the disengagement position, retaining ring 611 is retained in place by partitioning boards 737 of housing 715, and spring 599 is compressed. When control tube 571 reaches the disengagement position, inner teeth 597 of control tube 571 disengage from teeth 695 of positioning ring 679. When rotating sleeve 631 is rotated while control tube 571 is in the disengagement position, control tube 571 is rotated and causes rotation of pole 111 through transmission by seat 171 and axle 196. Canopy 475 and ribs 451 also rotate about the longitudinal axis of pole 111 to a desired position (FIG. 15) to shield users from the sun.

After canopy 475 reaches the desired position, rotating sleeve 631 is released, spring 599 biasing operation end 573 of control tube 571 to return control tube 571 from the disengagement position (FIG. 14) to the engagement position (FIG. 4) in which teeth 597 of control tube 571 reengage with teeth 695 of positioning ring 679. Thus, control tube 571 can not pivot about the longitudinal axis of pole 111 even if canopy 475 is under a wind load.

By using control tube 571 and positioning ring 679 to control rotational movement of pole 111, canopy 475 in the tilted position can be moved to the desired position by rotating pole 111 to obtain a better shielding effect.

Since runner 297 is moved along the longitudinal axis of pole 111 by using screw rod 511, less force is required to unfold canopy 475. Further, operation for tilting canopy 475 is force-saving by using screw rod 511 to actuate follower 277 while providing reinforced structural strength. Further, large pitch portion 519 of screw rod 511 rapidly moves follower 277 between the folded position and the unfolded position, rapidly folding or unfolding canopy 475.

Furthermore, sliding sleeve 547 can push runner 297 towards hub 439 without moving receiving tube 531, engagement member 300, and follower 277, moving the distal end of each rib 451 out of the rotating path of handle 213. Thus, handle 213 can be smoothly rotated to unfold canopy 475 without interference by the distal end of any rib 451.

Furthermore, canopy 475 in the tilted state can be adjusted according to the position of the sun, providing enhanced sun-shielding effect. Furthermore, the angular displacement of pivotable member 383 about the pivot axis defined by pin 401 can be more precisely controlled by small pitch portion 517 of screw rod 511 that moves follower 277 slowly, precisely controlling the tilted state of canopy 475. Further, when pivotable member 383 is in the first position, first sections 377 of sliding grooves 375 of fixing member 363 and first track sections 397 of tracks 395 of pivotable member 383 are parallel to the longitudinal axis of pole 111 to reliably retain pivotable member 383 in the first position. Thus, pivotable member 383 would not pivot from the first position to the second position even if canopy 475 in the unfolded state is under a strong wind load. Furthermore, since each stretcher 313 can pivot about the corresponding screw 477 while tilting canopy 475, pivotable member 383 can smoothly pivot from the first position to the second position.

Now that the basic teachings of the present invention have been explained, many extensions and variations will be obvious to one having ordinary skill in the art. For example, rotatable sunshade 12 does not have to include rotational tube 697. In this case, lower end 115 of pole 111 is rotatably mounted to first coupling section 659 of connection tube 657. Furthermore, connection tube 657 does not have to include third coupling section 673, and the inner diameter of positioning ring 679 is slightly larger than first coupling section 659 of connection tube 657, with teeth 695 of positioning ring 679 providing engagement/disengagement with/from inner teeth 597 of control tube 571.

Furthermore, rotatable sunshade 12 does not have to include rotating sleeve 631. In this case, the shape of operation end 573 of control tube 571 can be modified to allow gripping by the user for moving control tube 571 between the engagement position and the disengagement position. The number of teeth 595, inner teeth 597, inner teeth 617, outer teeth 619, teeth 653, and teeth 695 can be varied according to need.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A rotatable sunshade comprising:

a pole (111) including upper and lower ends (113, 115) spaced from each other along a longitudinal axis of the pole (111), with the pole (111) further including an outer periphery (112) and an inner periphery (114) spaced from the outer periphery (112) in a radial direction perpendicular to the longitudinal axis of the pole (111), with the inner periphery (114) of the pole (111) defining a longitudinal hole (117);

a connection tube (657) including first and second coupling sections (659, 671) spaced from each other along the longitudinal axis of the pole (111), with the lower end (115) of the pole (111) rotatably coupled to the first coupling section (659) of the connection tube (657), with the second coupling section (671) of the connection tube (657) adapted to be fixed to a base (467);

a positioning ring (679) fixed around the connection tube (657), with the positioning ring (679) including first and second faces (691, 693), with at least one tooth (695) formed on the second face (693) of the positioning ring (679) and extending beyond an outer periphery of the connection tube (657);

a runner (297) mounted around the pole (111) and slideable relative to the pole (111);

a plurality of stretchers (313) each having a first end (315) pivotably connected to the runner (297) and a second end (317) spaced from the first end (315) along a longitudinal axis of the stretcher (313), with the plurality of stretchers (313) jointly movable with the runner (297) and the follower (277);

a fixing member (363) fixed to the upper end (113) of the pole (111);

a pivotable member (383) pivotably connected to the fixing member (363);

a hub (439) mounted to the pivotable member (383), with the hub (439) and the pivotable member (383) jointly pivotable between first and second positions;

a plurality of ribs (451) each including a connecting end (453) pivotably connected to the hub (439), with the second end (317) of each of the plurality of stretchers (313) pivotably connected to one of the plurality of ribs (451), with a canopy (475) adapted to be mounted to the plurality of ribs (451);

a housing (715) mounted around the pole (111), with the housing (715) including a partitioning board (737) dividing an interior of the housing (715) into a movement space (739) and a mounting space (750) below the movement space (739) along the longitudinal axis of the pole (111);

a control tube (571) mounted around the pole (111), with the control tube (571) including an operation end (573) and an engagement end (575) spaced from the operation end (573) along the longitudinal axis of the pole (111), with the control tube (571) further including an inner periphery (576) and an outer periphery (578) spaced from the inner periphery (576) in a radial direction perpendicular to the longitudinal axis of the pole (111), with the inner periphery (576) of the control tube (571) defining a receiving hole (577) receiving the pole (111) and the connection tube (657), with at least one tooth (597) formed on the inner periphery (576) of the control tube (571) at the engagement end (575), with the operation end (573) of the control tube (571) located outside of the movement space (739) of the housing (715), with the engagement end (575) of the control tube (571) located in the mounting space (750), with the positioning ring (679) located above the at least one tooth (597) of the control tube (571), with the control tube (571) slideable along the longitudinal axis of the pole (111) between an engagement position and a disengagement position;

a retaining ring (611) mounted around the control tube (571) and between the operation end (573) and the engagement end (575), with the retaining ring (611) received in the movement space (739) and abutting the partitioning board (737);

a spring (599) mounted between the operation end (573) of the control tube (571) and the retaining ring (611), with the spring (599) biasing the control tube (571) from the disengagement position to the engagement position;

wherein when the runner (297) moves along the longitudinal axis of the pole (111) towards the hub (439), the plurality of stretchers (313) moves the plurality of ribs (451) away from the pole (111) for unfolding the canopy (475), wherein when the runner (297) moves along the longitudinal axis of the pole (111) away from the hub (439), the plurality of stretchers (313) moves the plurality of ribs (451) towards the pole (111) for folding the canopy (475), with the canopy (475) unfolded and the pivotable member (383) in the first position, the canopy (475) is not tilted relative to the pole (111), with the canopy (475) unfolded and the pivotable member (383) in the second position, the canopy (475) is tilted relative to the pole (111), with the canopy (475) tilted and the control tube (571) in the engagement position, the at least one tooth (597) of the control tube (571) engages with the at least one tooth (695) of the positioning ring (679), the pole (111) is not rotatable about the longitudinal axis relative to the connection tube (657), and with the canopy (475) tilted and the control tube (571) in the disengagement position, the at least one tooth (597) of the control tube (571) disengages from the at least one tooth (695) of the positioning ring (679), the pole (111) is rotatable about the longitudinal axis relative to the connection tube (657).

2. The rotatable sunshade as claimed in claim 1, with the connection tube (657) further including a third coupling section (673) between the first and second coupling sections (659, 671), with a first shoulder (675) formed between the second and third coupling sections (659, 673), with a second shoulder (677) formed between the first and third coupling sections (671, 673), with the plurality of teeth (695) of the positioning ring (679) abutting the first shoulder (675), with a rotational tube (697) rotatably mounted to the first coupling section (659) of the connection tube (657), with the rotational tube (697) including an abutment flange (699) at a lower end thereof, with the abutment flange (699) having an end face abutting the second shoulder (677) of the connection tube (657), with the rotational tube (697) fixed to the lower end (115) of the pole (111) and jointly rotatable with the pole (111), with the lower end (115) of the pole (111) abutting the abutment flange (699) of the rotational tube (697).

3. The rotatable sunshade as claimed in claim 1, with the control tube (571) further including at least one tooth (595) on the outer periphery (578) at the operation end (573) of the control tube (571), with a rotating sleeve (631) coupled to the operation end (573) of the control tube (571), with the rotating sleeve (631) including upper and lower ends (633, 635) spaced from each other along the longitudinal axis of the pole (111), with the rotating sleeve (631) further including an inner periphery (639) defining a compartment (651), with at least one tooth (653) formed on the inner periphery (639) of the rotating sleeve (631) and engaged with the at least one tooth (595) of the control tube (571), with the rotating sleeve (631) jointly rotatable with the control tube (571), with the lower end (635) of the rotating sleeve (631) received in the movement space (739) of the housing (715) and located above the partitioning board (737) of the housing (715), with the control tube (571) in the engagement position, when the rotating sleeve (631) is moved away from the hub (439) along the longitudinal axis of the pole (111), the control tube (571) is moved from the engagement position to the disengagement position, with the control tube in the disengagement position, when the rotating sleeve (631) is moved towards the hub (439) along the longitudinal axis of the pole (111), the control tube (571) is moved from the disengagement position to the engagement position, and with the control tube (571) in the disengagement position, when the rotating sleeve (631) is rotated about the longitudinal axis of the pole (111), the control tube (571) rotates jointly with the rotating sleeve (631).

4. The rotatable sunshade as claimed in claim 1, with the control tube (571) further including two receiving slots (593), with each of the two receiving slots (593) extending from an end face of the operation end (573) towards but spaced from the engagement end (575), with the retaining ring (611) including an inner periphery (613) with two inner teeth (617), with each of the two inner teeth (617) slideably received in one of the two receiving slots (593) of the control tube (571), with the spring (599) biasing the retaining ring (611) to press against each of the two inner teeth (617) against a bottom of one of the two receiving slots (593), wherein when the control tube (571) moves between the engagement position and the disengagement position, the retaining ring (611) is not moved, each of the two receiving slots (593) slideably receiving one of the two inner teeth (617) of the retaining ring (611).

5. The rotatable sunshade as claimed in claim 1, with the pole (111) further including a slot (119) extending from the outer periphery (112) through the inner periphery (114) of the pole (111), with the pole (111) further including a first hole (137) extending from the inner periphery (114) through the outer periphery (112) of the pole (111), with the control tube (571) further including a first opening (579) extending from the inner periphery (576) through the outer periphery (578) of the control tube (571), with the pivotable member (383) including a track (395), with the rotatable sunshade further comprising:

a first transmission member (151) rotatably mounted in the first hole (137), with the first transmission member (151) including a toothed portion (155) located in the longitudinal hole (117) of the pole (111);

a handle (213) located outside of the pole (111) and fixed to the first transmission member (151), with the handle (213) and the first transmission member (151) jointly rotatable about a rotating axis perpendicular to the longitudinal axis of the pole (111), with the first opening (579) receiving the first transmission member (151) when the control tube (571) moves between the engagement position and the disengagement position;

an axle (196) coupled to and jointly rotatable with the first transmission member (151), with the axle (196) including a head (197) outside of the first transmission member (151);

a handle (213) coupled to the head (197) of the axle (196), with the handle (213), the first transmission member (151), and the axle (196) jointly rotatable about the rotating axis;

a support (235) fixed in the longitudinal hole (117) of the pole (111) and located above the first transmission member (151) along the longitudinal axis of the pole (111);

a second transmission member (251) received in the longitudinal hole (117) of the pole (111), with the second transmission member (251) including a shaft (255) rotatably supported by the support (235), with the second transmission member (251) further including a toothed portion (253) meshed with the toothed portion (155) of the first transmission member (151), with the second transmission member (251) rotating about the longitudinal axis of the pole (111) when the first transmission member (151) rotates about the rotating axis;

a screw rod (511) including a lower end (515) fixed to the second transmission member (251) and an upper end (513), with the screw rod (511) including a small pitch portion (517) at the upper end (513) thereof and a large pitch portion (519) extending from a lower end of the small pitch portion (517) to the lower end (515) of the screw rod (511), with the large pitch portion (519) having a pitch larger than a pitch of the small pitch portion (517), with the screw rod (511) and the second transmission member (251) jointly rotatable about the longitudinal axis of the pole (111);

a follower (277) received in the longitudinal hole (117) of the pole (111) and threadedly engaged with the screw rod (511), with rotation of the screw rod (511) about the longitudinal axis of the pole (111) causing movement of the follower (277) along the longitudinal axis of the pole (111) between a folded position, an unfolded position, and a tilted position, with a first spacing between the follower (277) in the folded position and the second transmission member (251) along the longitudinal axis of the pole (111) being smaller than a second spacing between the follower (277) in the unfolded position and the second transmission member (251) along the longitudinal axis of the pole (111), with the second spacing being smaller than a third spacing between the follower (277) in the tilted position and the second transmission member (251) along the longitudinal axis of the pole (111);

a receiving tube (531) mounted around the pole (111) and slideable along the longitudinal axis of the pole (111), with the receiving tube (531) including a top end (532) and a bottom end (534), with the receiving tube (531) further including inner and outer peripheries (533, 535) spaced from each other in the radial direction and extending between the top and bottom ends (532, 534), with the inner periphery (533) of the receiving tube (531) defining a longitudinal hole (537), with an engagement groove (543) defined in the outer periphery (535) of the receiving tube (531) and having a bottom wall spaced from the inner periphery (533) of the receiving tube (531), with a slot (544) extending from the bottom wall of the engagement groove (543) through the inner periphery (533) of the receiving tube (531), with the longitudinal hole (537) of the receiving tube (531)

receiving the pole (111), with the slot (544) of the receiving tube (531) aligned with the slot (119) of the pole (111);

an engagement member (300) including a body (304) received in the engagement groove (543) of the receiving tube (531), with the engagement member (300) further including an insertion portion (302) extending from the body (304), with the insertion portion (302) of the engagement member (300) extending through the slot (544) of the receiving tube (531) and the slot (119) of the pole (111), with the insertion portion (302) engaged with the engagement hole (293) of the follower (277), allowing joint movement of the runner (297), the receiving tube (531), the engagement member (300), and the follower (277) between the folded position, unfolded position, and tilted position;

a sliding sleeve (547) mounted around the receiving tube (531), with the sliding sleeve (547) including an abutment end (549) fixed to the lower end (307) of the runner (297), with the sliding sleeve (547) and the runner (297) jointly slideable along the receiving tube (531), a fixing member (363) fixed to the upper end (113) of the pole (111), with the fixing member (363) including a sliding groove (375) and a pin hole (381);

an actuation rod (403) slideably extending through the sliding groove (375) of the fixing member (363) and slideably received in the track (395) of the pivotable member (383);

a link (471) including a first connection end (472) connected to the actuation rod (403) and a second connection end (473);

a connection member (405) including a first end (407) pivotably connected to the second connection end (473) of the link (471) and a second end (409);

a positioning pin (415) extending through the connection member (405) in a radial direction perpendicular to the longitudinal axis of the pole (111), with the positioning pin (415) having two ends located outside of the connection member (405);

a second spring (421) mounted around the connection member (405) and including a first end (423) abutting the fixing member (363) and a second end (425) abutting the two ends of the positioning pin (415), wherein when the follower (277) moves between the folded position and the unfolded position, the follower (277) moves along the large pitch portion (519) at a first speed, wherein when the follower (277) is in the folded position, the follower (277) is spaced from the second end (409) of the connection member (405) along the longitudinal axis of the pole (111) and located adjacent to the lower end (515) of the screw rod (511), the pivotable member (383) is in the first position with each of the plurality of stretchers (313) and the plurality of ribs (451) located adjacent to the pole (111), and with the canopy (475) adapted to be in a collapsed state, wherein when the follower (277) is in the unfolded position, the follower (277) is around an intersection between the large pitch portion (519) and the small pitch portion (517), the pivotable member (383) is in the first position, and the canopy (475) is adapted to be unfolded by the plurality of stretchers (313) and the plurality of ribs (451), wherein when the follower (277) moves from the unfolded position to the tilted position, the follower (277) is driven by the small pitch portion (517) of the screw rod (511) at a second speed smaller than the first speed to push the connection member (405) to move along the longitudinal axis of the pole (111), causing compression of the second spring (421) by the positioning pin (415), the connection member (405) actuates the link (471) to move the actuation rod (403) along the sliding groove (375) of the fixing member (363), the actuation rod (403) presses against a wall of the track (395) of the pivotable member (383) to pivot the pivotable member (383) from the first position to the second position, the hub (439), the plurality of ribs (451), and the plurality of stretchers (313) pivot together with the pivotable member (383), the hub (439) and the plurality of ribs (451) are tilted relative to the pole (111), and wherein when the follower (277) moves from the tilted position to the unfolded position, the second spring (421) presses against the positioning pin (415) to cause the connection member (405) and the link (471) to move jointly along the longitudinal axis of the pole (111), the actuation rod (403) presses against the wall of the track (395) of the pivotable member (383) to pivot the pivotable member (383) from the second position to the first position, the hub (439) and the plurality of ribs (451) are not tilted relative to the pole (111) when the pivotable member (383) is in the first position.

6. The rotatable sunshade as claimed in claim 5, with a flange (536) formed on the outer periphery (535) of the receiving tube (531) and located on the top end (532) of the receiving tube (531), with the sliding sleeve (547) further including a positioning end (551) spaced from the abutment end (549) along the longitudinal axis of the pole (111), with the sliding sleeve (547) further including an inner periphery (553) extending between the abutment end (549) and the positioning end (551) and defining a sliding hole (557), with an inner protruded portion (555) formed on the inner periphery (553) of the sliding sleeve (547) and located at the positioning end (551), with the receiving tube (531) slideably received in the sliding hole (557) of the sliding sleeve (547), with the follower (277) in the folded position, the inner protruded portion (555) of the receiving tube (531) is spaced from the flange (536) of the receiving tube (531), and with the follower (277) in the folded position, when the sliding sleeve (54) moves along the longitudinal axis of the pole (111) towards the hub (439) and pushes the runner (297), the flange (536) of the receiving tube (531) is in a movement path of the inner protruded portion (555) of the receiving tube (531), preventing the sliding sleeve (547) from being disengaged from the receiving tube (531).

7. The rotatable sunshade as claimed in claim 5, with the pitch of the large pitch portion (519) of the screw rod (511) being between 7 mm and 12 mm, with the pitch of the small pitch portion (517) of the screw rod (511) being between 2 mm and 4 mm.

8. The rotatable sunshade as claimed in claim 5, with the pivotable member (383) pivotable between the first and second positions in a pivotal movement plane perpendicular to the pivot axis defined by the pin (401) and including the longitudinal axis of the pivotable member (383), and with the rotatable sunshade (12) further comprising:

a plug (319) fixed in the first end (315) of each of the plurality of stretchers (313), with each plug (319) including a screw hole (325);

a pivotal seat (327) mounted to each plug (319), with each pivotal seat (327) including a first surface (329) and a second surface (331) opposite to the first surface (329), with a mounting hole (332) extending from the first surface (329) through the second surface (331), with a pivotal hole (337) extending perpendicularly to and intersecting with the mounting hole (332), and with each pivotal seat (327) pivotably connected to the runner (297) by a pivotal pin (311) extending through the mounting hole (332); and a plurality of screws (477) each including a head (479) securely received in the mounting hole (332) of one of the pivotal seats (327) and spaced from the pivotal pin (311) received in one of the pivotal seats (327), with each of the plurality of screws (477) further including a shank (481) loosely engaged in the screw hole (325) of one of the plugs (319), and with each plug (319) and a corresponding one of the plurality of stretchers (313) being pivotable about a corresponding one of the plurality of screws (477), and wherein when the follower (277) moves from the unfolded position to the tilted position, each of the plurality of stretchers (313) whose longitudinal axis is not located in the pivotal movement plane pivots about a pivot axis defined by the pivotal pin (311) mounted to a corresponding one of the pivotal seats (327) and pivots about the corresponding one of the plurality of screws (477) while the pivotable member (383) pivots from the first position to the second position in the pivotal movement plane.

9. The rotatable sunshade as claimed in claim 5, with the sliding groove (375) of the fixing member (363) including a first section (377) parallel to the longitudinal axis of the pole (111) and a second section (379) at an obtuse angle to the first section (377), with the track (395) of the pivotable member (383) including a first track section (397) and a second track section (399), wherein when the pivotable member (383) is in the first position, the first track section (397) of the track (395) of the pivotable member (383) is aligned with the first section (377) of the sliding groove (375) of the fixing member (363), the actuation rod (403) is received in the first track section (397) of the track (395) of the pivotable member (383) and the first section (377) of the sliding groove (375) of the fixing member (363), wherein when the pivotable member (383) pivots from the first position to the second position, the actuation rod (403) moves into the second track section (399) of the track (395) of the pivotable member (383) and the second section (379) of the sliding groove (375) of the fixing member (363), and wherein when the pivotable member (383) pivots from the second position to the first position, the actuation rod (403) moves from the second track section (399) into the first track section (397) of the track (395) of the pivotable member (383) and moves from the second section (379) into the first section (377) of the sliding groove (375) of the fixing member (363).

10. The rotatable sunshade as claimed in claim 5, further comprising: a connecting member (257) mounted between the screw rod (511) and the second transmission member (251), with the connecting member (257) including a first end (259) and a second end (273), with a first receptacle (271) defined in an end face of the first end (259) of the connecting member (257), with a second receptacle (275) defined in an end face of the second end (273) of the connecting member (257), with the lower end (515) of the screw rod (511) fixed in the second receptacle (275), with the shaft (255) fixed in the first receptacle (271), and with the second transmission member (251), the connecting member (257), and the screw rod (511) not movable along the longitudinal axis of the pole (111).

* * * * *